US009497802B2

(12) United States Patent
Nakayama

(10) Patent No.: US 9,497,802 B2
(45) Date of Patent: Nov. 15, 2016

(54) HEATER AND IMAGE HEATING APPARATUS INCLUDING THE SAME

(71) Applicant: CANON KABUSHIKI KAISHA, Tokyo (JP)

(72) Inventor: Toshinori Nakayama, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/718,557

(22) Filed: May 21, 2015

(65) Prior Publication Data

US 2015/0341985 A1 Nov. 26, 2015

(30) Foreign Application Priority Data

May 26, 2014 (JP) ..... 2014-108591

(51) Int. Cl.

| | |
|---|---|
| ***G03G 15/20*** | (2006.01) |
| ***H05B 3/00*** | (2006.01) |
| ***H05B 3/03*** | (2006.01) |
| ***H05B 3/06*** | (2006.01) |

(52) U.S. Cl.

CPC ..... *H05B 3/0014* (2013.01); *G03G 15/2042* (2013.01); *G03G 15/2053* (2013.01); *H05B 3/03* (2013.01); *H05B 3/06* (2013.01); *G03G 2215/2035* (2013.01)

(58) Field of Classification Search

CPC ..... G03G 15/80; G03G 15/2042; G03G 15/2053; H01C 17/06; H01C 17/28; H01C 17/283; H05B 1/0241; H05B 3/20; H05B 2/34

See application file for complete search history.

(56) References Cited

U.S. PATENT DOCUMENTS

| | | | |
|---|---|---|---|
| 6,084,208 | A | 7/2000 | Okuda et al. |
| 7,203,438 | B2 | 4/2007 | Omata et al. |
| 7,260,351 | B2 | 8/2007 | Nakayama |

(Continued)

FOREIGN PATENT DOCUMENTS

| | | |
|---|---|---|
| EP | 2711778 A2 | 3/2014 |
| JP | 2005-234540 | 9/2005 |

(Continued)

OTHER PUBLICATIONS

European Search Report issued in counterpart European Patent Application No. 15168843.9, dated Nov. 3, 2015.

(Continued)

*Primary Examiner* — Erika J Villaluna

(74) *Attorney, Agent, or Firm* — Fitzpatrick, Cella, Harper & Scinto

(57) ABSTRACT

A heater usable with an image heating apparatus including first and second terminals. The heater includes: first and second electrodes connectable to the first and second terminals, respectively, and extending longitudinally; heat generating portions between adjacent electrodes; a first electroconductive line connected with the first electrodes and extending with a gap between the heat generating portions; a second electroconductive line connected with the second electrodes connected with the heat generating portions in a first heat generating region; and a third electroconductive line connected with one of the second electrodes connected with the heat generating portions in a second heat generating region and extending adjacent to the second electric line. A gap between the second and third electroconductive lines in the widthwise direction is smaller than the gap between the first and second electrodes in the widthwise direction.

15 Claims, 17 Drawing Sheets

(56) References Cited

U.S. PATENT DOCUMENTS

| | | | |
|---|---|---|---|
| 7,263,303 | B2 | 8/2007 | Nakayama |
| 7,343,130 | B2 | 3/2008 | Nakayama |
| 7,430,392 | B2 | 9/2008 | Ito et al. |
| 7,460,821 | B2 | 12/2008 | Ai et al. |
| 7,505,724 | B2 | 3/2009 | Nakayama |
| 7,590,366 | B2 | 9/2009 | Nakayama |
| 7,729,628 | B2 | 6/2010 | Nakayama |
| 7,907,861 | B2 | 3/2011 | Nakayama |
| 8,145,086 | B2 | 3/2012 | Chiyoda et al. |
| 8,306,446 | B2 | 11/2012 | Ito et al. |
| 8,559,837 | B2 | 10/2013 | Nakayama |
| 8,712,271 | B2 | 4/2014 | Nakayama et al. |
| 8,750,739 | B2 | 6/2014 | Tamaki et al. |
| 2005/0163523 | A1 | 7/2005 | Omata et al. |
| 2012/0076521 | A1 | 3/2012 | Ishihara et al. |
| 2012/0224876 | A1 | 9/2012 | Nakayama et al. |
| 2013/0299480 | A1 | 11/2013 | Kakubari et al. |
| 2013/0322897 | A1 | 12/2013 | Yago et al. |
| 2014/0076878 | A1 | 3/2014 | Shimura |
| 2014/0353303 | A1 | 12/2014 | Fudo et al. |

FOREIGN PATENT DOCUMENTS

| | | |
|---|---|---|
| JP | 2012-037613 | 2/2012 |
| JP | 2014-235315 | 12/2014 |

OTHER PUBLICATIONS

U.S. Appl. No. 14/794,869 to Toshinori Nakayama, filed Jul. 9, 2015.

U.S. Appl. No. 14/718,672 to Toshinori Nakayama, filed May 21, 2015.

U.S. Appl. No. 14/719,497 to Toshinori Nakayama, filed May 22, 2015.

U.S. Appl. No. 14/719,474 to Toshinori Nakayama, filed May 22, 2015.

U.S. Appl. No. 14/799,056 to Masayuki Tamaki et al., filed Jul. 14, 2015.

(a)

(b)

HEATER AND IMAGE HEATING APPARATUS INCLUDING THE SAME

FIELD OF THE INVENTION AND RELATED ART

The present invention relates to a heater for heating an image on a sheet and an image heating apparatus provided with the same. The image heating apparatus is usable with an image forming apparatus, such as a copying machine, a printer, a facsimile machine, a multifunction machine having a plurality of functions thereof, or the like.

An image forming apparatus is known in which a toner image is formed on the sheet and is fixed on the sheet by heat and pressure in a fixing device (image heating apparatus). As for such a fixing device, a type of fixing device has been recently proposed (Japanese Laid-open Patent Application 2012-37613) in which a heat generating element (heater) contacts an inner surface of a thin flexible belt to apply heat to the belt. Such a fixing device is advantageous in that the structure has a low thermal capacity, and therefore, the temperature rise that is sufficient to permit the fixing operation is quick.

Such a fixing device is advantageous in that the structure has a low thermal capacity, and therefore, the temperature rise that is sufficient to permit the fixing operation is quick. FIG. 16 is a circuit diagram of the heater disclosed in Japanese Laid-open Patent Application 2012-37613. As shown in FIG. 16, the fixing device comprises electrodes 1027 (1027*a*-1027*f*) arranged in a longitudinal direction of a substrate 1021 and heat generating resistance layers 1025), and the electric power supply is supplied through the electrodes to the heat generating resistance layers 1025 (1025*a*-1025*e*) so that the heat generating resistance layer generates heat.

In this fixing device, each electrode is electrically connected with electroconductive line layers 1029 (1029*a*, 1029*b*) formed on the substrate. The electroconductive line layer extends toward a longitudinal end portion of the substrate, and is connectable with a voltage supply circuit by an electroconductive member. More particularly, an electroconductive line layer 1029*d* connected with a plurality of electrodes, an electroconductive line layer 1029*h* connected with an electrode 1027*b* and an electroconductive line layer 1029 *g* connected with an electrode 1027*d* extend toward the one longitudinal end of the substrate. The plurality of electrodes connected with the electroconductive line layer 1029*d* are electrodes 1027*a*, 1027*c*, 1027*e*, 1027*g*, 1027*i*, 1027*k*, 1027*m*, 1027*o*. An electroconductive line layer 1029*c* connected with a plurality of electrodes, an electroconductive line layer 1029*i* connected with an electrode 1027*q*, and an electroconductive line layer 1029*j* connected with an electrode 1027*s* extend toward the other longitudinal end of the substrate. The plurality of electrodes connected with the electroconductive line layer 1029*c* are electrodes 1027*f*, 1027*h*, 1027*j*, 10271, 1027*n*, 1027*p*, 1027*r*, 1027*t*.

In the one end portion of the substrate with respect to the longitudinal direction, the electrode 1027*a* and the electroconductive line layers 1029 *g* and *g*, 1029*h* are connectable with the electroconductive members, respectively. In the other end portion of the substrate with respect to the longitudinal direction, the electrode 1027*f* and the electroconductive line layers 1029*i* and 1029*j* are connectable with respective electroconductive members. More specifically, the opposite longitudinal end portions of the substrate are not coated with an insulation layer for protecting the electroconductive lines, and therefore, the electrodes 1027*a*, 1027*t* and electroconductive line layers 1029*g*, 1029*h*, 1029*i*, 1029*j* are exposed. By the electroconductive member contacting the exposed portions of the electrodes 1027*a*, 1027*t* and the electroconductive line layers 1029*g*, 1029*h*, 1029*i*, 1029*j*, a heat generating element 1006 is connected to the voltage supply circuit.

The voltage supply circuit includes an AC voltage source and switches 1033 (1033*e*, 1033*f*, 1033*g*, 1033*h*), by combinations of the actuations of which a heater energization pattern is controlled. That is, each electroconductive line layer 1029 is connected with either one of a voltage source contact 1031*a* or a voltage source contact 1031*b*, depending on the connection pattern in the voltage supply circuit. With such a structure, the fixing device of Japanese Laid-open Patent Application 2012-37613 changes the width of the heat generating region of the heat generating resistance layer 1025 in accordance with the width size of the sheet.

The fixing device of Japanese Laid-open Patent Application 2012-37613 involves an improvement of the electroconductive lines. The voltage source contact (1031*a* or 1031*b*) that the electroconductive line layers on the substrate contact, changes depending on the connection pattern in the voltage supply circuit, and therefore, a large potential difference can be produced between adjacent electroconductive lines.

As shown in FIG. 16, when the heat generating element 1006 generates heat for a maximum size (width) sheet, the electroconductive line layer 1029*i* and the electroconductive line layer 1029*j* are connected with the voltage source contact 1031*a*. Therefore, the potentials of the electroconductive line layer 1029*i* and the electroconductive line layer 1029*j* are substantially the same. On the other hand, when the heat generating element 1006 generates heat for an intermediate size (width) sheet, the electroconductive line layer 1029*i* is connected with the voltage source contact 1031*a*, and in the electroconductive line layer 1029*j* is connected with the voltage source contact 1031*b*. Therefore, a large potential difference is produced between the electroconductive line layer 1029*i* and the electroconductive line layer 1029*j*.

The adjacent electroconductive lines are required to be insulated so as not to cause a short circuit therebetween, and for this purpose a gap is required therebetween. A short circuit tends to occur more frequently when the potential difference between the electroconductive lines is large, and therefore, an assured insulation is required when the potential difference between the electroconductive lines is large. Therefore, the gap between the electroconductive lines with the possibility of large potential difference therebetween tends to be large.

Thus, the gap between the electroconductive line layer 1029*i* and the electroconductive line layer 1029*j* is large. This results in wide space for providing the electroconductive lines on the substrate 1021, which requires a large width of the substrate. For this reason, there is an increase in cost of the heater 600 with the upsizing of the substrate 1021. However, it is desirable to provide a heater that heats an image having a changeable heat generating region width size. Therefore, it is desirable to suppress the increase of the width of the substrate resulting from the configuration of the electroconductive lines on the substrate.

SUMMARY OF THE INVENTION

It is an object of the present invention to provide a heater with which the increase of the width of the substrate is suppressed.

According to an aspect of the present invention, there is provided a heater usable with an image heating apparatus including an electric energy supplying portion provided with a first terminal and a second terminal, and an endless belt for heating an image on a sheet. The heater is contactable to the belt to heat the belt. The heater comprises: a plurality of electrode portions including a plurality of first electrode portions electrically connectable with the first terminal and a plurality of second electrode portions electrically connectable the second terminal. The first electrode portions and the second electrode portions are arranged in a longitudinal direction of the substrate with spaces between adjacent electrode portions. The heater also comprises: a plurality of heat generating portions, provided between adjacent electrode portions, respectively, for generating heat by electric power supply between adjacent electrode portions; and a first electroconductive line portion electrically connected with the plurality of first electrode portions and extending in the longitudinal direction with a gap between itself and the plurality of heat generating portions, in one end portion side with respect to a widthwise direction of the substrate beyond the plurality of heat generating portions. The heater also includes a second electroconductive line portion electrically connected with the second electrode portion electrically connected with the heat generating portions in a first heat generating region arranged in the longitudinal direction, the second electroconductive line portion extending in the longitudinal direction in the other end portion side with respect to the widthwise direction beyond the plurality of heat generating portions. The heater further includes a third electroconductive line portion electrically connected with the second electrode portion electrically connected with the heat generating portions in a second heat generating region arranged in the longitudinal direction, the second electroconductive line portion extending adjacent to the second electroconductive line portion in the longitudinal direction in the other end portion side with respect to the widthwise direction beyond the plurality of heat generating portions. A gap between the second electroconductive line portion and the third electroconductive line portion in the widthwise direction is smaller than the gap between the first electroconductive line portion and the second electrode portion in the widthwise direction.

According to another aspect of the present invention, there is provided an image heating apparatus comprising: an electric energy supplying portion provided with a first terminal and a second terminal; a belt configured to heat an image on a sheet; a substrate provided inside the belt and extending in a widthwise direction of the belt; and a plurality of electrode portions including a plurality of first electrode portions electrically connectable the first terminal and a plurality of second electrode portions electrically connectable the second terminal. The first electrode portions and the second electrode portions are arranged in a longitudinal direction of the substrate with spaces between adjacent electrode portions. The apparatus further comprises: a plurality of heat generating portions, provided between adjacent electrode portions, respectively, for generating heat by electric power supply between adjacent electrode portions; and a first electroconductive line portion electrically connected with the plurality of first electrode portions, the first electroconductive line portion extending in the longitudinal direction with a gap between itself and the plurality of heat generating portions, in one end portion side with respect to a widthwise direction of the substrate beyond the plurality of heat generating portions. The apparatus further comprises a second electroconductive line portion electrically connected with the second electrode portion electrically connected with the heat generating portions in a first heat generating region arranged in the longitudinal direction, the second electroconductive line portion extending in the longitudinal direction in the other end portion side with respect to the widthwise direction beyond the plurality of heat generating portions. The apparatus also comprises: a third electroconductive line portion electrically connected with the second electrode portion electrically connected with the heat generating portions in a second heat generating region arranged in the longitudinal direction, the second electroconductive line portion extending adjacent to the second electroconductive line portion in the longitudinal direction in the other end portion side with respect to the widthwise direction beyond the plurality of heat generating portions. When a sheet having a maximum width usable with the apparatus is heated, electric energy is supplied through the first electroconductive line and all of electroconductive line portions including the second electroconductive line portion and the third electroconductive line portion so that all of the heat generating portions generate heat. When a sheet having a width smaller than the maximum width is heated, electric energy is supplied through the first electroconductive line portion and a part of the electroconductive line portions so that a part of the heat generating portions generate heat. A gap between the second electroconductive line portion and the third electroconductive line portion in the widthwise direction is smaller than the gap between the first electroconductive line portion and the second electrode portion in the widthwise direction.

Further features of the present invention will become apparent from the following description of exemplary embodiments with reference to the attached drawings.

DESCRIPTION OF THE EMBODIMENTS

Embodiments of the present invention will be described in conjunction with the accompanying drawings. In this embodiment, the image forming apparatus is a laser beam printer using an electrophotographic process as an example. The laser beam printer will be simply called a printer.

Embodiment 1

Image Forming Apparatus

Figure 1:
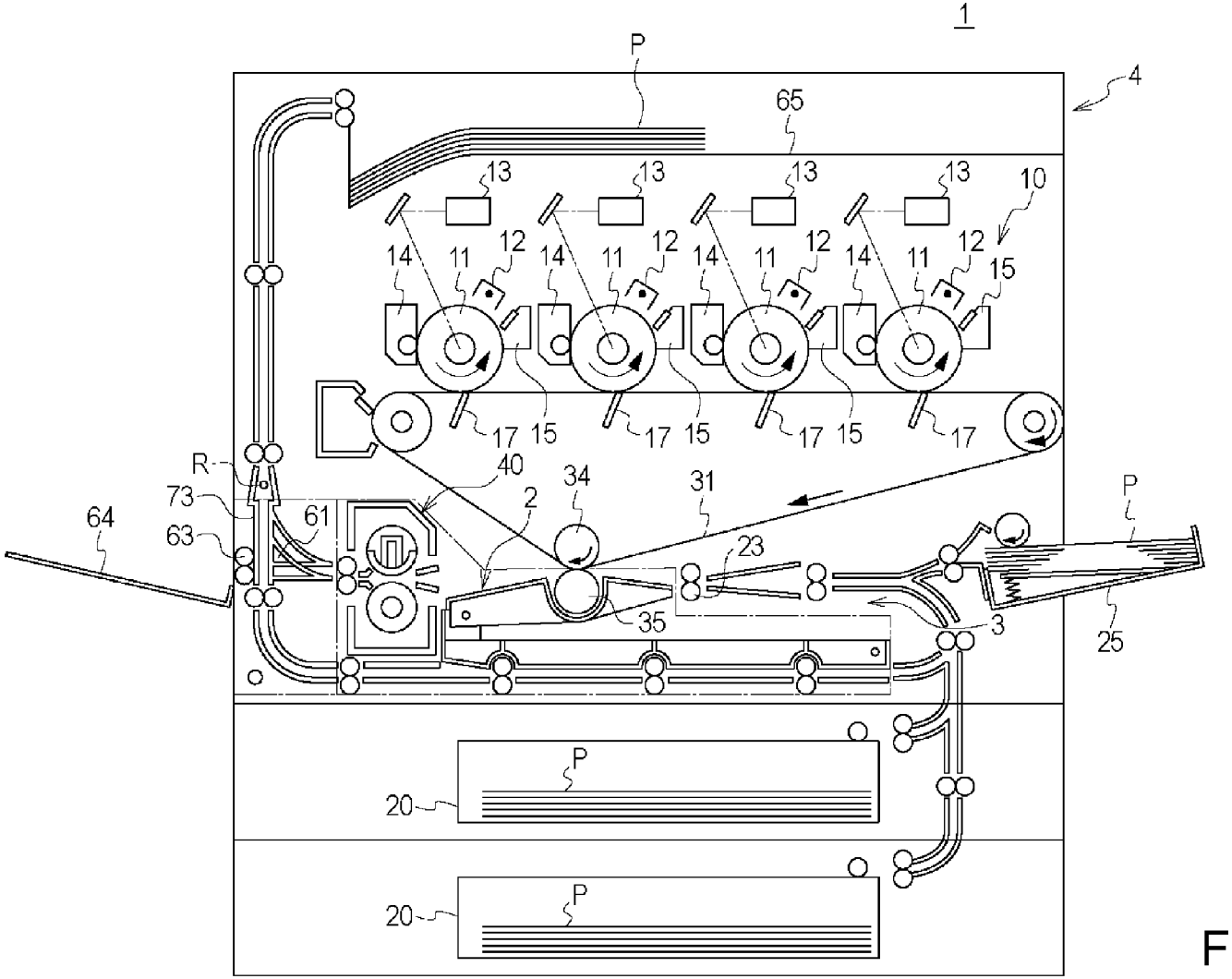
FIG. 1 is a section of view of the image forming apparatus according to an Embodiment 1 of the present invention.

FIG. 1 is a sectional view of the printer 1 which is the image forming apparatus of this embodiment. The printer 1 comprises an image forming station 10 and a fixing device 40, in which a toner image formed on the photosensitive drum 11 is transferred onto a sheet P, and is fixed on the sheet P, by which an image is formed on the sheet P. Referring to FIG. 1, the structures of the apparatus will be described in detail.

As shown in FIG. 1, the printer 1 includes image forming stations 10 for forming respective color toner images Y (yellow), M (magenta), C (cyan) and Bk (black). The image forming stations 10 includes respective photosensitive drums 11 corresponding to Y, M, C, Bk colors are arranged in the order named from the left side. Around each drum 11, similar elements are provided as follows: a charger 12; an exposure device 13; a developing device 14; a primary transfer blade 17; and a cleaner 15. The structure for the Bk toner image formation will be described as a representative, and the descriptions for the other colors are omitted for simplicity by assigning like reference numerals thereto. So, the elements will be simply be called photosensitive drum 11, charger 12, exposure device 13, developing device 14, primary transfer blade 17 and cleaner 15 with these reference numerals.

The photosensitive drum 11 as an electrophotographic photosensitive member is rotated by a driving source (unshown) in the direction indicated by an arrow (counterclockwise direction in FIG. 1). Around the photosensitive drum 11, the charger 12, the exposure device 13, the developing device 14, the primary transfer blade 17 and the cleaner 15 are provided in the order named.

A surface of the photosensitive drum 11 is electrically charged by the charger 12. Thereafter, the surface of the photosensitive drum 11 exposed to a laser beam in accordance with image information by the exposure device 13, so that an electrostatic latent image is formed. The electrostatic latent image is developed into a Bk toner image by the developing device 14. At this time, similar processes are carried out for the other colors. The toner image is transferred from the photosensitive drum 11 onto an intermediary transfer belt 31 by the primary transfer blade 17 sequentially (primary-transfer). The toner remaining on the photosensitive drum 11 after the primary-image transfer is removed by the cleaner 15. By this, the surface of the photosensitive drum 11 is cleaned so as to be prepared for the next image formation operation.

On the other hand, the sheets P contained in a feeding cassette 20 are also able to be placed on a multi-feeding tray 25, to be picked up by a feeding mechanism (unshown) and fed to a pair of registration rollers. The sheet P is a member on which the image is formed. Specific examples of the sheet P are plain paper, a thick sheet, a resin material sheet, an overhead projector film or the like. The pair of registration rollers 23 once stops the sheet P the correct oblique feeding. The registration rollers 23 then feed the sheet P into the space between the intermediary transfer belt 31 and the secondary transfer roller 35 in timed relation with the toner image on the intermediary transfer belt 31. The roller 35 functions to transfer the color toner images from the belt 31 onto the sheet P. Thereafter, the sheet P is fed into the fixing device (image heating apparatus) 40. The fixing device 40 applies heat and pressure to the toner image T on the sheet P to fix the toner image on the sheet P.

[Fixing Device]

Figure 2:
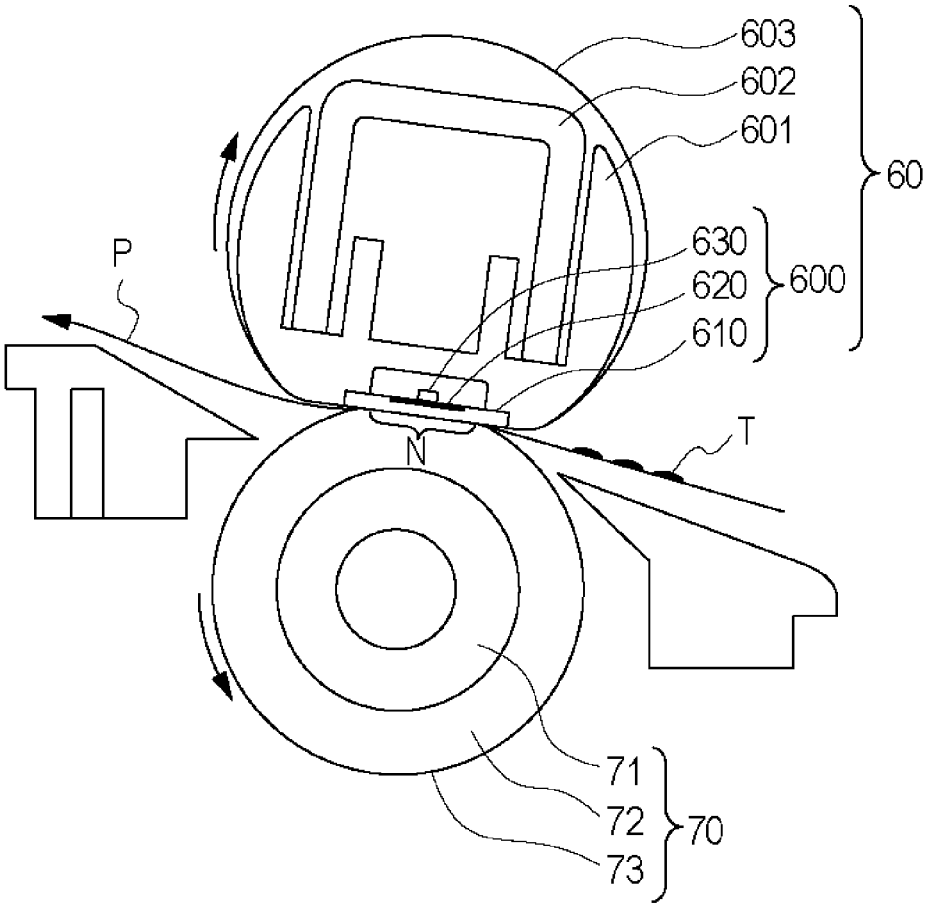
FIG. 2 is a sectional view of an image heating apparatus according to an Embodiment 1 of the present invention.
Figure 3:
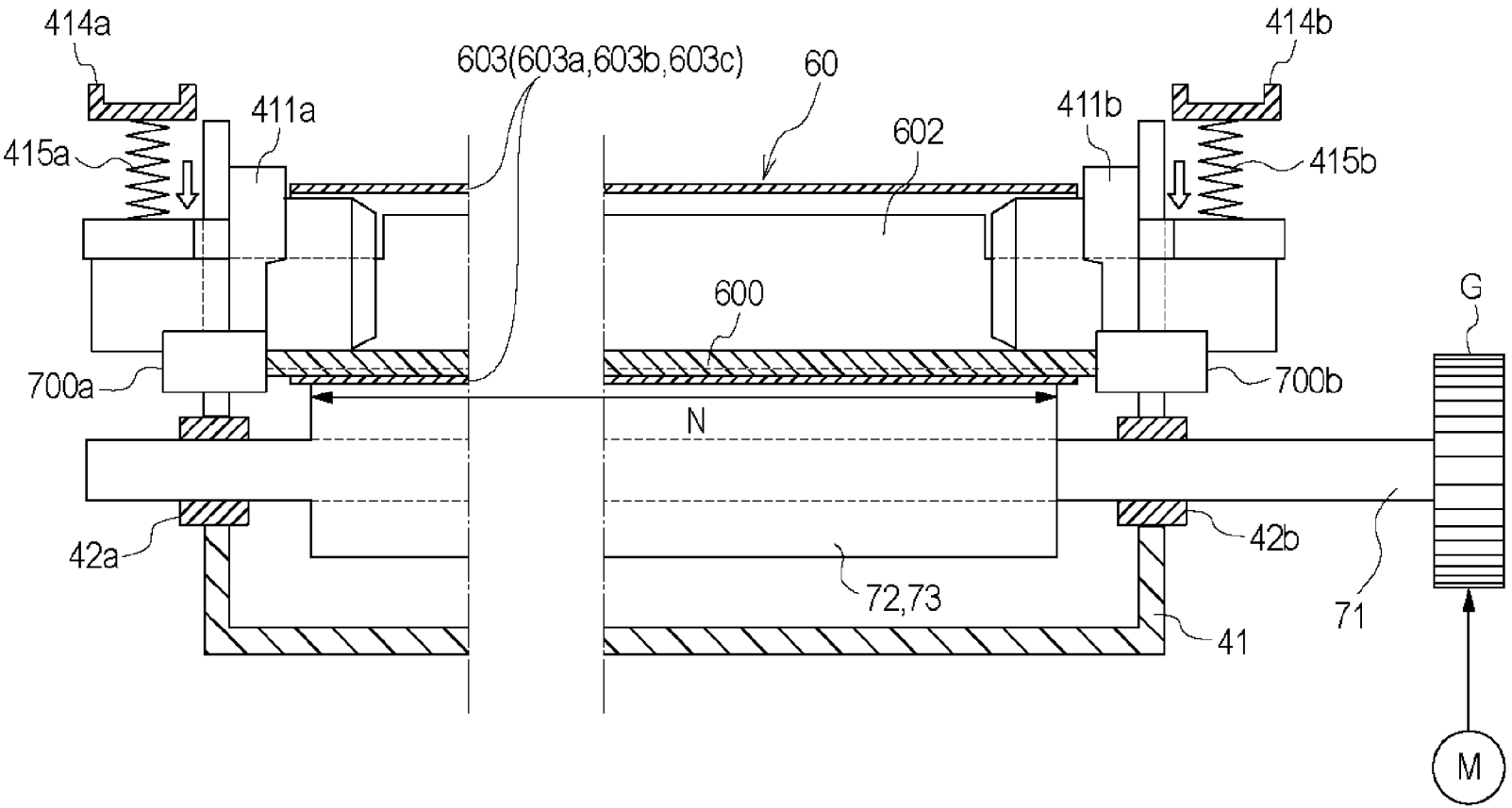
FIG. 3 is a front view of an image heating apparatus according to Embodiments 1 of the present invention.
Figure 5:
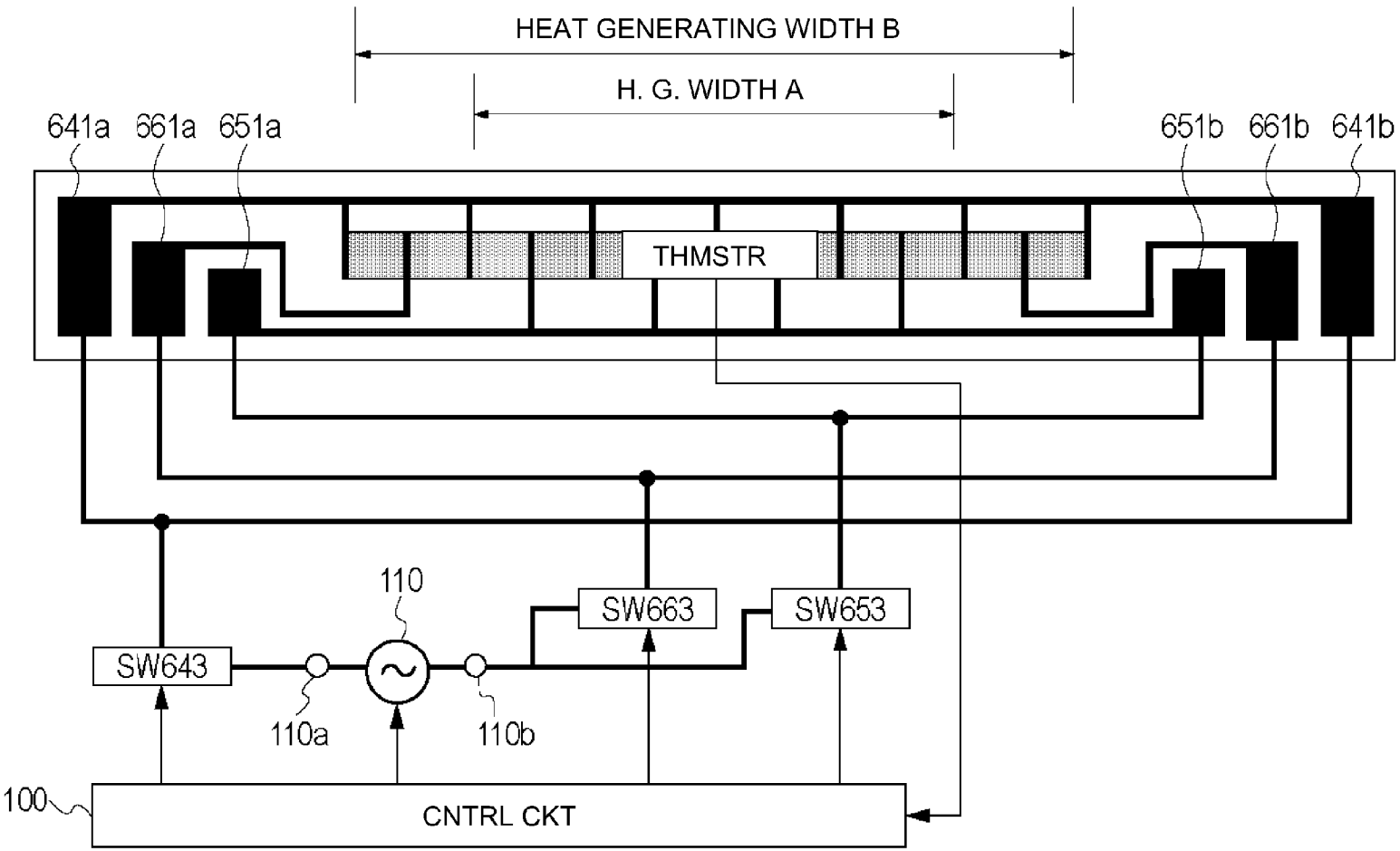
FIG. 5 illustrates the structural the relationship of the image heating apparatus according to an Embodiment 1.

The fixing device 40 which is the image heating apparatus used in the printer 1 will be described FIG. 2 is a sectional view of the fixing device 40 FIG. 3 is a front view of the fixing device 40 FIG. 5 illustrates a structural relationship of the fixing device 40.

The fixing device 40 is an image heating apparatus for heating the image on the sheet by a heater unit 60 (unit 60). The unit 60 includes a flexible thin fixing belt 603 and a heater 600 contacted to the inner surface of the belt 603 to heat the belt 603 (low thermal capacity structure). Therefore, the belt 603 can be efficiently heated, so that a quick temperature rise at the start of the fixing operation is accomplished. As shown in FIG. 2, the belt 603 is nipped between the heater 600 and the pressing roller 70 (roller 70), by which a nip N is formed. The belt 603 rotates in the direction indicated by the arrow (clockwise in FIG. 2), and the roller 70 is rotated in the direction indicated by the arrow (counterclockwise in FIG. 2) to nip and feed the sheet P supplied to the nip N. At this time, the heat from the heater 600 is supplied to the sheet P through the belt 603, and therefore, the toner image T on the sheet P is heated and pressed by the nip N, so that the toner image it fixed on the sheet P by the heat and pressure. The sheet P having passed through the fixing nip N is separated from the belt 603 and is discharged. In this embodiment, the fixing process is carried out as described above. The structure of the fixing device 40 will be described in detail.

Unit 60 is a unit for heating and pressing an image on the sheet P. A longitudinal direction of the unit 60 is parallel with the longitudinal direction of the roller 70. The unit 60 comprises a heater 600, a heater holder 601, a support stay 602 and a belt 603.

The heater 600 is a heating member for heating the belt 603, slidably contacting with the inner surface of the belt 603. The heater 600 is pressed to the inside surface of the belt 603 toward the roller 70 so as to provide a desired nip width of the nip N. The dimensions of the heater 600 in this embodiment are 5-20 mm in the width (the dimension as measured in the left-right direction in FIG. 2), 350-400 mm in the length (the dimension measured in the front-rear direction in FIG. 2), and 0.5-2 mm in the thickness. The heater 600 comprises a substrate 610 elongated in a direction perpendicular to the feeding direction of the sheet P (widthwise direction of the sheet P), and a heat generating resistor 620 (heat generating element 620).

The heater 600 is fixed on the lower surface of the heater holder 601 along the longitudinal direction of the heater holder 601. In this embodiment, the heat generating element 620 is provided on the back side of the substrate 610, which is not in slidable contact with the belt 603, but the heat generating element 620 may be provided on the front surface of the substrate 610, which is in slidable contact with the belt 603. However, the heat generating element 620 is preferably provided on the back side of the substrate 610, by which a uniform heating effect to the substrate 610 is accomplished, from the standpoint of preventing non-uniform heat application, which may be caused by a non-heat generating portion of the heat generating element 620. The details of the heater 600 will be described hereinafter.

The belt 603 is a cylindrical (endless) belt (film) for heating the image on the sheet in the nip N. The belt 603 comprises a base material 603*a*, an elastic layer 603*b* thereon, and a parting layer 603*c* on the elastic layer 603*b*, for example. The base material 603*a* may be made of metal material such as stainless steel or nickel, or a heat resistive resin material such as polyimide. The elastic layer 603*b* may be made of an elastic and heat resistive material such as a silicone rubber or a fluorine-containing rubber. The parting layer 603*c* may be made of fluorinated resin material or silicone resin material.

The belt 603 of this embodiment has dimensions of approx. 30 mm in the outer diameter, approx. 330 mm in the length (the dimension measured in the front-rear direction in FIG. 2), approx. 30 μm in the thickness, and the material of the base material 603*a* is nickel. The silicone rubber elastic layer 603*b* having a thickness of approx. 400 μm is formed on the base material 603*a*, and a fluorine resin tube (parting layer 603*c*) having a thickness of approx. 20 μm coats the elastic layer 603*b*.

The belt contacting surface of the substrate 610 may be provided with a polyimide layer having a thickness of approx. 10 μm as a sliding layer 603*d*. When the polyimide layer is provided, the rubbing resistance between the fixing belt 603 and the heater 600 is low, and therefore, the wearing of the inner surface of the belt 603 can be suppressed. In order to further enhance the slidability, a lubricant such as grease may be applied to the inner surface of the belt.

The heater holder 601 (holder 601) functions to hold the heater 600 in the state of urging the heater 600 toward the inner surface of the belt 603. The holder 601 has a semi-arcuate cross-section (the surface of FIG. 2) and functions to regulate a rotation orbit of the belt 603. The holder 601 may be made of heat resistive resin material or the like. In this embodiment, it is Zenite 7755 (tradename) available from Dupont.

The support stay 602 supports the heater 600 by way of the holder 601. The support stay 602 is preferably made of a material which is not easily deformed even when a high pressure is applied thereto, and in this embodiment, it is made of SUS304 (stainless steel).

As shown in FIG. 3, the support stay 602 is supported by left and right flanges 411*a* and 411*b* at the opposite end portions with respect to the longitudinal direction. The flanges 411*a* and 411*b* may be simply called the flange 411. The flange 411 regulates the movement of the belt 603 in the longitudinal direction and the circumferential direction configuration of the belt 603. The flange 411 is made of heat resistive resin material or the like. In this embodiment, it is PPS (polyphenylenesulfide resin material).

Between the flange 411*a* and a pressing arm 414*a*, an urging spring 415*a* is compressed. Also, between a flange 411*b* and a pressing arm 414*b*, an urging spring 415*b* is compressed. The urging springs 415*a* and 415*b* may be simply called the urging spring 415. With such a structure, an elastic force of the urging spring 415 is applied to the heater 600 through the flange 411 and the support stay 602. The belt 603 is pressed against the upper surface of the roller 70 at a predetermined urging force to form the nip N having a predetermined nip width. In this embodiment, the pressure is approx. 156.8 N at one end portion side and approx. 313.6 N (32 kgf) in total.

As shown in FIG. 3, a connector is provided as an electric energy supply member electrically connected with the heater 600 to supply the electric power to the heater 600. The connectors 700*a*, 700*b* may be simply called the connector 700*a*, 700*b*. The connector 700*a*, 700*b* is detachably provided at one longitudinal end portion of the heater 600. The connector 700*a*, 700*b* is detachably provided at the other longitudinal end portion of the heater 600. The connector 700*a*, 700*b* is easily detachably mounted to the heater 600, and therefore, assembling of the fixing device 40 and the exchange of the heater 600 or belt 603 upon damage of the heater 600 is easy, thus providing a good maintenance property. Details of the connector 700*a*, 700*b* will be described hereinafter.

As shown in FIG. 2, the roller 70 is a nip forming member which contacts an outer surface of the belt 603 to cooperate with the belt 603 to form the nip N. The roller 70 has a multi-layer structure on a metal core of metal material, the multi-layer structure including an elastic layer 72 on the metal core 71 and a parting layer 73 on the elastic layer 72. Examples of the materials of the metal core 71 include SUS (stainless steel),), SUM (sulfur and sulfur-containing free-machining steel),), Al (aluminum) or the like. Examples of the materials of the elastic layer 72 include an elastic solid rubber layer, an elastic foam rubber layer, an elastic porous rubber layer or the like. Examples of the materials of the parting layer 73 include fluorinated resin material.

The roller 70 of this embodiment includes a metal core of steel, an elastic layer 72 of silicone rubber foam on the metal core 71, and a parting layer 73 of fluorine resin tube on the elastic layer 72. Dimensions of the portion of the roller 70 having the elastic layer 72 and the parting layer 73 are approx. 25 mm in outer diameter, and approx. 330 mm in length.

A thermistor 630 is a temperature sensor provided on a back side of the heater 600 (opposite side from the sliding surface side. The thermistor 630 is bonded to the heater 600 in the state that it is insulated from the heat generating element 620. The thermistor 630 has a function of detecting a temperature of the heater 600. As shown in FIG. 5, the thermistor 630 is connected with a control circuit 100 through an A/D converter (unshown) and feed an output corresponding to the detected temperature to the control circuit 100.

The control circuit 100 comprises a circuit including a CPU for operating various controls, and a non-volatile medium such as a ROM storing various programs. The programs are stored in the ROM, and the CPU reads and execute them to effect the various controls. The control circuit 100 may be an integrated circuit such as ASIC if it is capable of performing the similar operation.

As shown in FIG. 5, the control circuit 100 is electrically connected with the voltage source 110 so as to control is electric power supply from the electric energy supply circuit 110. The control circuit 100 is electrically connected with the thermistor 630 to receive the output of the thermistor 630.

The control circuit 100 uses the temperature information acquired from the thermistor 630 for the electric power supply control for the electric energy supply circuit 110. More particularly, the control circuit 100 controls the electric power to the heater 600 through the electric energy supply circuit 110 on the basis of the output of the thermistor 630. In this embodiment, the control circuit 100 carries out a wave number control of the output of the electric energy supply circuit 110 to adjust an amount of heat generation of the heater 600. By such a control, the heater 600 is maintained at a predetermined temperature (approx. 180 degree C., for example).

As shown in FIG. 3, the metal core 71 of the roller 70 is rotatably held by bearings 41*a* and 41*b* provided in a rear side and a front side of the side plate 41, respectively. One axial end of the metal core is provided with a gear G to transmit the driving force from a motor M to the metal core 71 of the roller 70. As shown in FIG. 2, the roller 70 receiving the driving force from the motor M rotates in the direction indicated by the arrow (clockwise direction). In the nip N, the driving force is transmitted to the belt 603 by the way of the roller 70, so that the belt 603 is rotated in the direction indicated by the arrow (counterclockwise direction).

The motor M is a driving portion for driving the roller 70 through the gear G. As shown in FIG. 5, the control circuit 100 is electrically connected with the motor M to control the electric power supply to the motor M. When the electric energy is supplied by the control of the control circuit 100, the motor M starts to rotate the gear G.

The control circuit 100 controls the rotation of the motor M. The control circuit 100 rotates the roller 70 and the belt 603 using the motor M at a predetermined speed. It controls the motor so that the speed of the sheet P nipped and fed by the nip N in the fixing process operation is the same as a predetermined process speed (approx. 200 [mm/sec], for example).

[Heater]

Figure 4:
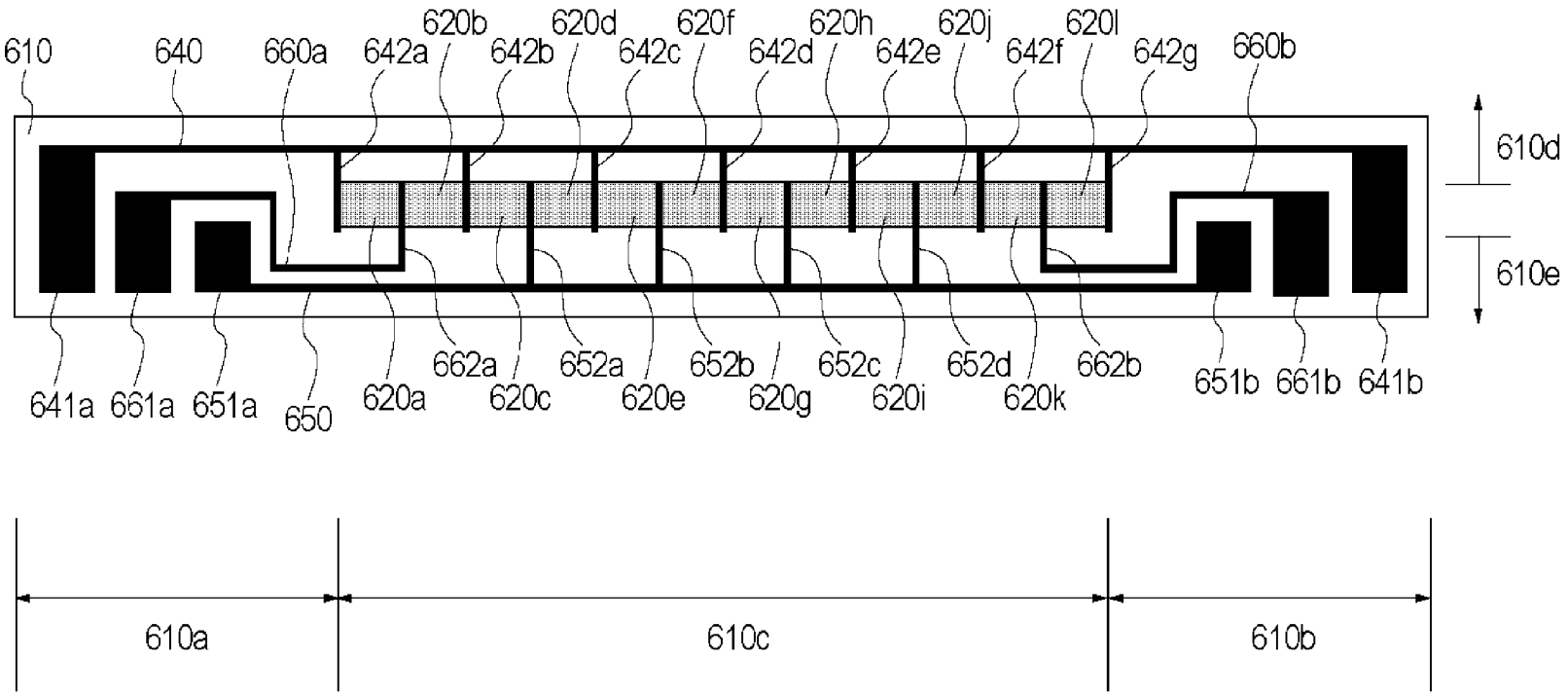
FIG. 4 illustrates a structure of a heater of Embodiment 1.
Figure 6:
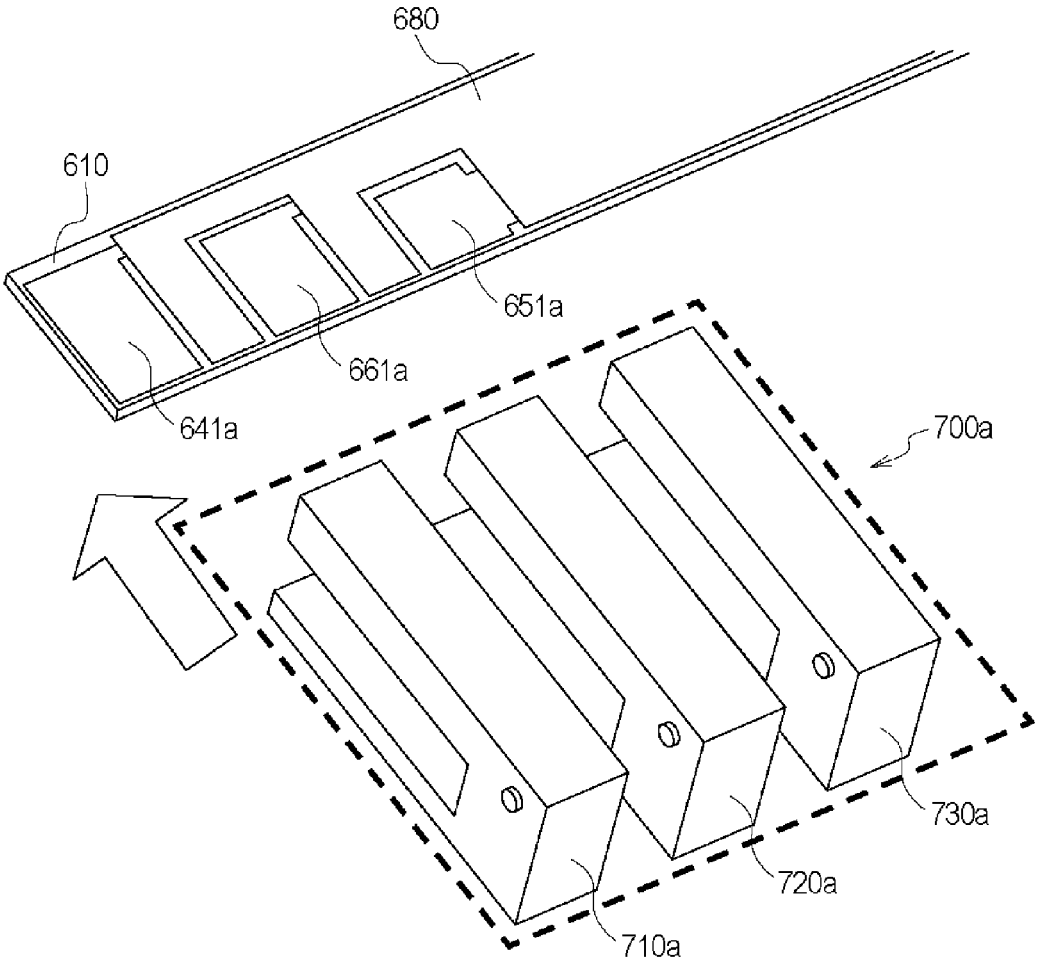
FIG. 6 illustrates a connector.
Figure 17:
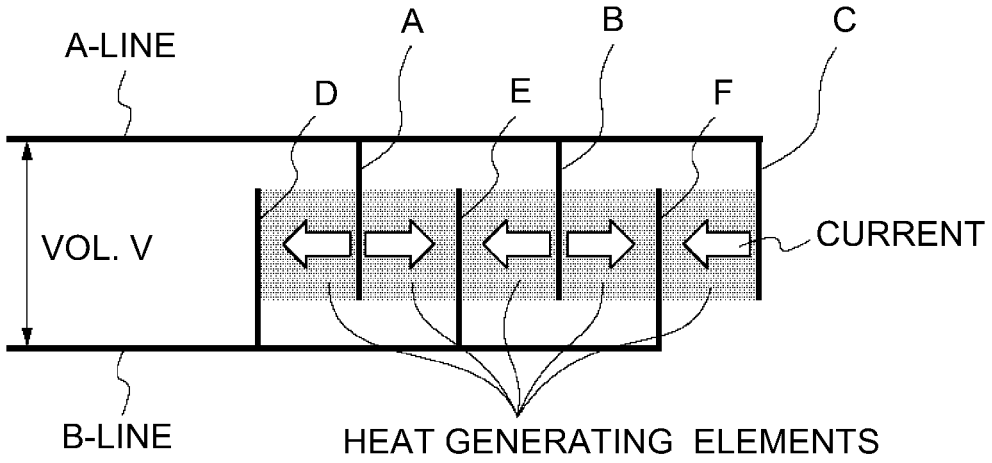
FIG. 17 is an illustration (a) of heat generating type used with a heater, and an illustration (b) of a switching type for a heat generating region used with the heater.
Figure 17:
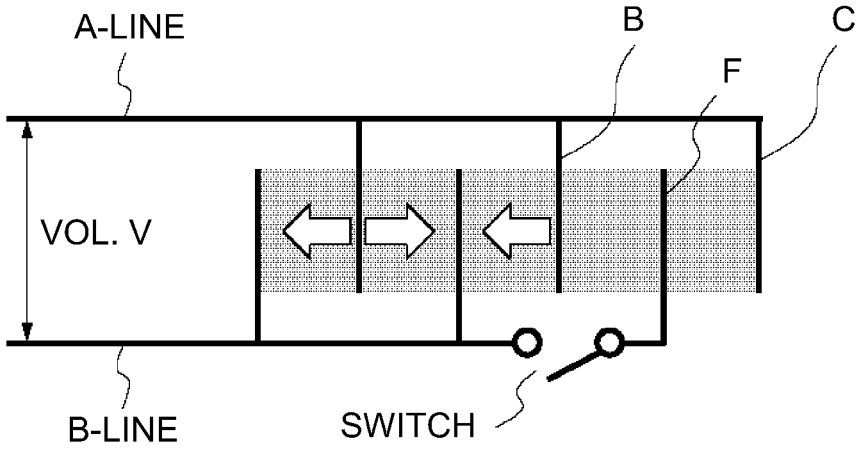

The structure of the heater 600 used in the fixing device 40 will be described in detail. FIG. 4 illustrates a structure of a heater Embodiment 1. FIG. 6 illustrates a connector. Part (a) of FIG. 17 illustrates a heat generating type used in the heater 600. Part (b) of FIG. 17 illustrates a heat generating region switching type used with the heater 600.

Figure 11:
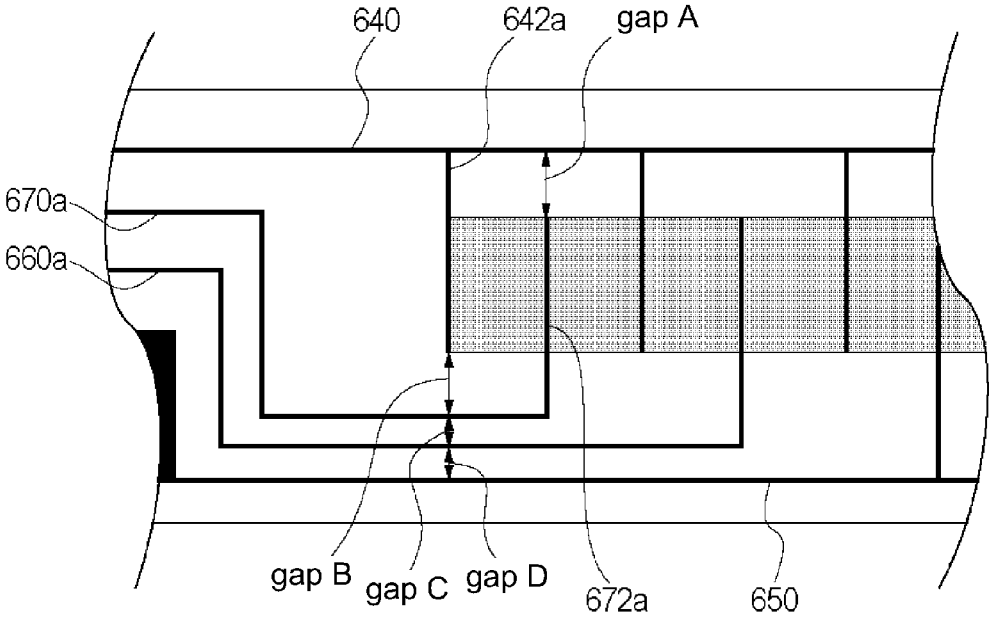
FIG. 11 is an illustration of the electroconductive lines on the substrate in Embodiment 2.

The heater 600 of this embodiment is a heater using the heat generating type shown in parts (a) and (b) of FIG. 11. As shown in part (a) of FIG. 17, electrodes A-C are electrically connected with the A-electroconductive-line, and electrodes D-F are electrically connected with B-electroconductive-line. The electrodes connected with the A-electroconductive-lines and the electrodes connected with the B-electroconductive-lines are interlaced (alternately arranged) along the longitudinal direction (left-right direction in part (a) of FIG. 11), and heat generating elements are electrically connected between the adjacent electrodes. When a voltage V is applied between the A-electroconductive-line and the B-electroconductive-line, a potential difference is generated between the adjacent electrodes. As a result, electric currents flow through the heat generating elements, and the directions of the electric currents through the adjacent heat generating elements are opposite to each other. In this type heater, the heat is generated in the above-described the manner. As shown in part (b) of FIG. 17, between the B-electroconductive-line and the electrode F, a switch or the like is provided, and when the switch is opened, the electrode B and the electrode C are at the same potential, and therefore, no electric current flows through the heat generating element therebetween. In this system, the heat generating elements arranged in the longitudinal direction are independently energized so that only a part of the heat generating elements can be energized by switching a part off. In other words, in the system, the heat generating region can be changed by providing a switch or the like in the electroconductive line. In the heater 600, the heat generating region of the heat generating element 620 can be changed using the above-described system.

The heat generating element generates heat when energized, irrespective of the direction of the electric current, but it is preferable that the heat generating elements and the electrodes are arranged so that the currents flow along the longitudinal direction. Such an arrangement is advantageous over the arrangement in which the directions of the electric currents are in the widthwise direction perpendicular to the longitudinal direction (up-down direction in part (a) of FIG. 11) in the following point. When joule heat generation is effected by the electric energization of the heat generating element, the heat generating element generates heat correspondingly to the resistance value thereof, and therefore, the dimension and the material of the heat generating element are selected in accordance with the direction of the electric current so that the resistance value is at a desired level. The dimension of the substrate on which the heat generating element is provided is very short in the widthwise direction as compared with that in the longitudinal direction. Therefore, if the electric current flows in the widthwise direction, it is difficult to provide the heat generating element with a desired resistance value, using a low resistance material. On the other hand, when the electric current flows in the longitudinal direction, it is relatively easy to provide the heat generating element with a desired resistance value, using the low resistance material. In the case that in heat generating element is made of a high resistance material, temperature non-uniformity may result because of thickness unevenness of the heat generating element. For example, when the heat generating element material is applied on the substrate along the longitudinal direction by screen printing or like, a thickness non-uniformity of about 5% may result in the widthwise direction. This is because a heat generating element material painting non-uniformity occurs due to a small pressure difference in the widthwise direction by a painting blade. For this reason, it is preferable that the heat generating elements and the electrodes are arranged so that the electric currents flow in the longitudinal direction.

In the case that the electric power is supplied individuality to the heat generating elements arranged in the longitudinal direction, it is preferable that the electrodes and the heat generating elements are disposed such that the directions of the electric current flow alternate between adjacent ones. As to the arrangements of the heat generating members and the electrodes, it would be considered to arrange the heat generating elements each connected with the electrodes at the opposite ends thereof, in the longitudinal direction, and the electric power is supplied in the longitudinal direction. However, with such an arrangement, two electrodes are provided between adjacent heat generating elements, with the result of the likelihood of a short circuit. In addition, the number of required electrodes is large with the result of a large non-heat generating portion. Therefore, it is preferable to arrange the heat generating elements and the electrodes such that an electrode is made common between adjacent heat generating elements. With such an arrangement, the likelihood of a short circuit between the electrodes can be avoided, and the non-heat generating portion can be made small.

Figure 12:
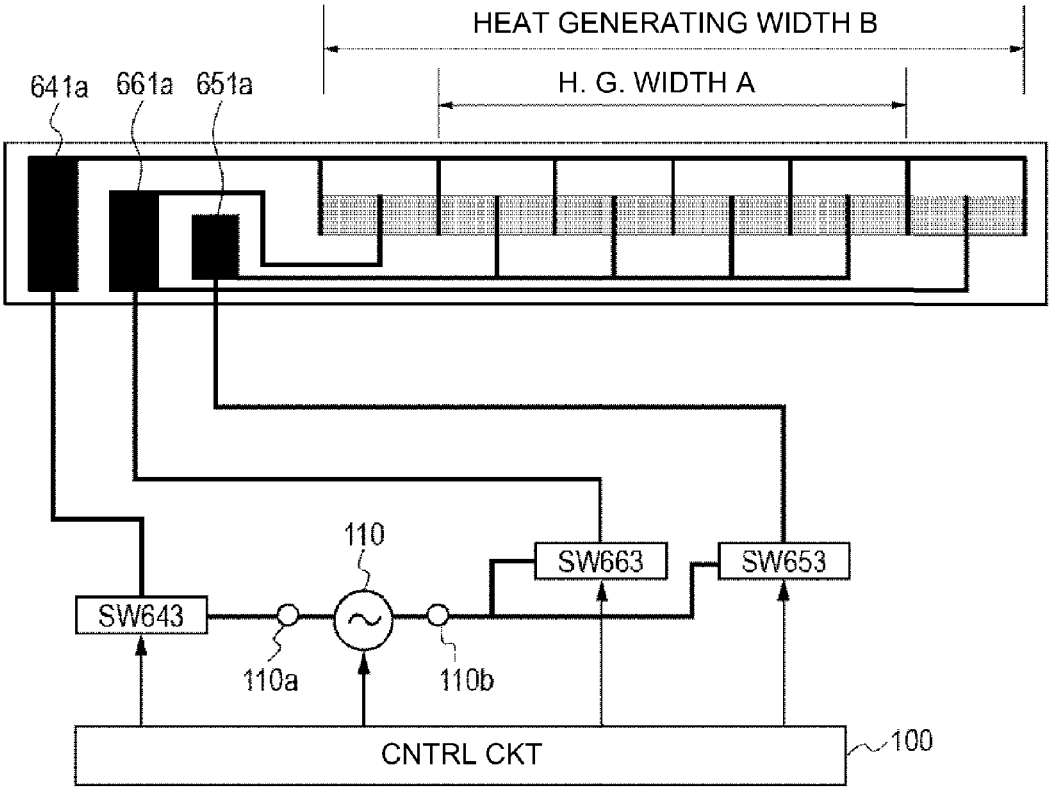
FIG. 12 illustrates the structural the relationship of the image heating apparatus according to an Embodiment 3.

In this embodiment, a common electroconductive line 640 corresponds to the A-electroconductive-line of part (a) of FIG. 12, and the opposite electroconductive lines 650, 660*a*, 660*b* correspond to B-electroconductive-line. In addition, common electrodes 642*a*-642 *g* correspond to electrodes A-C of part (a) of FIG. 12, and opposite electrodes 652*a*-652*d*, 662*a*, 662*b* correspond to electrodes D-F. Heat generating elements 620*a*-620*l* correspond to the heat generating elements of part (a) of FIG. 17. Hereinafter, the common electrodes 642*a*-642 *g* are simply called the common electrode 642. The opposite electrodes 652*a*-652*e* are simply called the opposite electrode 652. The opposite electrodes 652*a*-652*e* are simply called the opposite electrode 652. The opposite electroconductive lines 660*a*, 660*b* are simply called the opposite electroconductive line 660. The heat generating elements 620*a*-620*l* are simply called the heat generating element 620. The structure of the heater 600 will be described in detail referring to the accompanying drawings.

As shown in FIGS. 4 and 6, the heater 600 comprises the substrate 610, the heat generating element 620 on the substrate 610, an electroconductor pattern (electroconductive line), and an insulation coating layer 680 covering the heat generating element 620 and the electroconductor pattern.

The substrate 610 determines the dimensions and the configuration of the heater 600 and is contactable to the belt 603 along the longitudinal direction of the substrate 610. The material of the substrate 610 is a ceramic material such as alumina, aluminum nitride or the like, which has high heat resistivity, thermo-conductivity, electrical insulative property or the like. In this embodiment, the substrate is a plate member of alumina having a length (measured in the left-right direction in FIG. 4) of approx. 400 mm, a width (up-down direction in FIG. 4) of approx. 10 mm and a thickness of approx. 1 mm.

On the back side of the substrate 610, the heat generating element 620 and the electroconductor pattern (electroconductive line) are provided through a thick film printing method (screen printing method) using an electroconductive thick film paste. In this embodiment, a silver paste is used for the electroconductor pattern so that the resistivity is low, and a silver-palladium alloy paste is used for the heat generating element 620 so that the resistivity is high. As shown in FIG. 6, the heat generating element 620 and the electroconductor pattern coated with the insulation coating layer 680 of heat resistive glass so that they are electrically protected from leakage and short circuit.

As shown in FIG. 4, a one longitudinal end portion 610*a* of the substrate 610 is provided with electrical contacts 641*a*, 651*a*, 661*a* as a part of the electroconductor pattern. The other end portion side 610*b* of the substrate 610 is provided with the electrical contacts 641*b*, 651*b*, and 661*b* as a part of the electroconductor pattern. A longitudinally central region 610*c* of the substrate 610 is provided with the heat generating element 620 and common electrodes 642*a*-642 *g* and opposite electrodes 652*a*-652*e*, 662*a*-662*b* as a part of the electroconductor pattern. In one end portion side 610*d* of substrate 610 beyond the heat generating element 620 with respect to the widthwise direction, the common electroconductive line 640 as a part of the electroconductor pattern is provided. In the other end portion side 610*e* of the substrate 610 beyond the heat generating element 620 with respect to the widthwise direction, the opposite electroconductive lines 650 and 660 are provided as a part of the electroconductor pattern.

The heat generating elements 620 (620*a*-620*l*) are resistors for generating joule heat upon electric power supply thereto. The heat generating element 620 is one heat generating element member extending in the longitudinal direction on the substrate 610, and is disposed in the region 610*c* (FIG. 4) adjacent to the center portion of the substrate 610. The heat generating element 620 has a width (widthwise direction of the substrate 610) of 1-4 mm and a thickness of 5-20 μm, and it has a predetermined resistance value. The heat generating element 620 in this embodiment has the width of approx. 2 mm and the thickness of approx. 10 μm. A total length of the heat generating element 620 in the longitudinal direction is approx. 320 mm, which is enough to cover a width of the A4 size sheet P (approx. 297 mm in width).

On the heat generating element 620, seven common electrodes 642*a*-642 *g*, which will be described hereinafter, are laminated with intervals in the longitudinal direction. In other words, the heat generating element 620 is isolated into six sections by common electrodes 642*a*-642 *g* along the longitudinal direction. The lengths measured in the longitudinal direction of the substrate 610 of each section are approx. 53.3 mm. On central portions of the respective sections of the heat generating element 620, one of the six opposite electrodes 652, 662 (652*a*-652*d*, 662*a*, 662*b*) are laminated. In this manner, the heat generating element 620 is divided into 12 sub-sections. The heat generating element 620 divided into 12 sub-sections can be deemed as a plurality of heat generating elements 620*a*-620*l*. In other words, the heat generating elements 620*a*-620*l* electrically connect adjacent electrodes with each other. Lengths of the sub-section measured in the longitudinal direction of the substrate 610 are approx. 26.7 mm. Resistance values of the sub-section of the heat generating element 620 with respect to the longitudinal direction are approx. 120Ω. With such a structure, the heat generating element 620 is capable of generating heat in a partial area or areas with respect to the longitudinal direction.

The resistivities of the heat generating elements 620 with respect to the longitudinal direction are uniform, and the heat generating elements 620*a*-620*l* have substantially the same dimensions. Therefore, the resistance values of the heat generating elements 620*a*-620*l* are substantially equal. When they are supplied with electric power in parallel, the heat generation distribution of the heat generating element 620 is uniform. However, it is not inevitable that the heat generating elements 620*a*-620*l* have substantially the same dimensions and/or substantially the same resistivities. For example, the resistance values of the heat generating elements 620*a* and 620*l* may be adjusted so as to prevent temperature lowering at the longitudinal end portions of the heat generating element 620. At the positions of the heat generating element 620 where the common electrode 642 and the opposite electrode 652, 662 are provided, the heat generation of the heat generating element 620 is substantially zero. However, the heat uniforming function of the substrate 610 makes the influence on the fixing process negligible if the width of the electrode is not more than 1 mm, for example. In this embodiment, the width of each electrode is not more than 1 mm.

The common electrodes 642 (642*a*-642*g*) as a first electrode are a part of the above-described electroconductor pattern. The common electrode 642 extends in the widthwise direction of the substrate 610 perpendicular to the longitudinal direction of the heat generating element 620. In this embodiment, the common electrode 642 is laminated on the heat generating element 620. The common electrodes 642 are odd-numbered electrodes of the electrodes connected to the heat generating element 620, as counted from a one longitudinal end of the heat generating element 620. The common electrode 642 is connected to one contact 110*a* of the voltage source 110 through the common electroconductive line 640 which will be described hereinafter.

The opposite electrodes 652, 662 as a second electrode are a part of the above-described electroconductor pattern. The opposite electrodes 652, 662 extend in the widthwise direction of the substrate 610 perpendicular to the longitudinal direction of the heat generating element 620. The opposite electrodes 652, 662 are laminated on the heat generating element 620. The opposite electrodes 652, 662 are the other electrodes of the electrodes connected with the heat generating element 620 other than the above-described common electrode 642. That is, in this embodiment, they are even-numbered electrodes as counted from the one longitudinal end of the heat generating element 620.

That is, the common electrode 642 and the opposite electrodes 662, 652 are alternately arranged along the longitudinal direction of the heat generating element. The opposite electrodes 652, 662 are connected to the other contact 110*b* of the electric energy supply circuit 110 through the opposite electroconductive lines 650, 660 which will be described hereinafter.

The common electrode 642 and the opposite electrode 652, 662 function as electrode portions for supplying the electric power to the heat generating element 620.

In this embodiment, the odd-numbered electrodes are common electrodes 642, and the even-numbered electrodes are opposite electrodes 652, 662, but the structure of the heater 600 is not limited to this example. For example, the even-numbered electrodes may be the common electrodes 642, and the odd-numbered electrodes may be the opposite electrodes 652, 662.

In addition, in this embodiment, four of the all opposite electrodes connected with the heat generating element 620 are the opposite electrode 652. In this embodiment, two of the all opposite electrodes connected with the heat generating element 620 are the opposite electrode 662. However, the allotment of the opposite electrodes is not limited to this example, but may be changed depending on the heat generation widths of the heater 600. For example, two may be the opposite electrode 652, and four maybe the opposite electrode 662.

The common electroconductive line 640 as a first electroconductive line is a part the above-described electroconductor pattern. The common electroconductive line 640 extends along the longitudinal direction of the substrate 610 toward the opposite ends (610*a*, 610*b*) of substrate 610 in the one end portion side 610*d* of the substrate. The common electroconductive line 640 is connected with the common electrodes 642 (642*a*-642*g*), which are in turn connected with the heat generating element 620 (620*a*-620*l*). The opposite end portions of the common electroconductive line 640 are connected to the electrical contacts (641*a*, 641*b*) which will be described hereinafter, respectively.

The opposite electroconductive line 650 as a second electroconductive line is a part of the above-described electroconductor pattern. The opposite electroconductive line 650 extends along the longitudinal direction of the substrate 610 toward the opposite end portions (610*a*, 610*b*), in the other end portion side 610*e* of the substrate. The opposite electroconductive line 650 is connected with the opposite electrode 652 (652*a*-652*d*) connected to the heat generating element 620. The opposite end portions of the opposite electroconductive line 650 are connected with the electrical contacts 651 (651*a*, 651*b*) which will be described hereinafter.

The opposite electroconductive line 660 (660*a*, 660*b*) is a part of the above-described electroconductor pattern. The opposite electroconductive line 660*a* as a third electroconductive line extends along the longitudinal direction of the substrate 610 toward the one end portion side of the substrate, in the other end portion side 610*e* of the substrate. The opposite electroconductive line 660*a* is connected with the opposite electrode 662*a*, which is in turn connected with the heat generating element 620 (620*a*, 620*b*). The opposite electroconductive line 660 is connected to the electrical contact 661*a*, which will be described hereinafter. The opposite electroconductive line 660*b* as a fourth electroconductive line extends along the longitudinal direction of the substrate 610 toward the other end portion side 610*b* of the substrate, in the other end portion side 610*e* of the substrate. The opposite electroconductive line 660*b* is connected with the opposite electrode 662*b*, which is in turn connected with the heat generating element 620 (620*k*, 620*l*). The opposite electroconductive line 660*b* is connected to the electrical contact 651*b*, which will be described hereinafter.

The electrical contacts 641 (641*a*, 641*b*), 651 (651*a*, 651*b*), 661 (661*a*, 661*b*) are a part of the above-described electroconductor pattern. The electrical contacts 641*a*, 651*a*, 661*a*, are disposed in the one end portion side 610*a* of the substrate beyond the heat generating element 620 with gaps of approx. 4 mm in the longitudinal direction of the substrate 610. The electrical contacts 641*b*, 651*b*, 661*b* are arranged in the other end portion side 610*b* of the substrate with a gap of approx. 4 mm in the longitudinal direction. Each of the electrical contacts 641, 651, 661 preferably has an area of not less than 2.5 mm×2.5 mm in order to assure the reception of the electric power supply from the connector 700*a*, 700*b*, which will be described hereinafter. In this embodiment, the electrical contacts 641, 651, 661 have a length of approx. 3 mm measured in the longitudinal direction of the substrate 610 and a width of not less than 2.5 mm measured in the widthwise direction of the substrate 610. The electrical contacts 641*a*, 651*a*, 661*a*, are disposed in the one end portion side 610*a* of the substrate beyond the heat generating element 620 with gaps of approx. 4 mm in the longitudinal direction of the substrate 610. The electrical contacts 641*b*, 651*b*, 661*b* are arranged in the other end portion side 610*b* of the substrate beyond the heat generating element 620 with a gap of approx. 4 mm in the longitudinal direction of the substrate 610. As shown in FIG. 6, no insulation coating layer 680 is provided at the positions of the electrical contacts 641, 651, 661 so that the electrical contacts are exposed. Therefore, the electrical contacts 641, 651, 661 can be electrically connected with the connector 700.

When voltage is applied between the electrical contact 641 and the electrical contact 651 through the connection between the heater 600 and the connector 700*a*, 700*b*, a potential difference is produced between the common electrode 642 (642*b*-642*f*) and the opposite electrode 652 (652*a*-652*d*). Therefore, through the heat generating elements 620*c*, 620*d*, 620*e*, 620*f*, 620*g*, 620*h*, 620*i*, 620*j*, the currents flow along the longitudinal direction of the substrate 610, the directions of the currents through the adjacent heat generating elements being substantially opposite to each other. The heat generating elements 620*c*, 620*d*, 620*e*, 620*f*, 620*g*, 620*h*, 620*i* as a first heat generating region generate heat, respectively.

When voltage is applied between the electrical contact 641 and the electrical contact 661*a* through the connection between the heater 600 and the connector 700*a*, 700*b*, a potential difference is produced between the common electrode 642*a*-642*b*) and the opposite electrode 662*a*. Therefore, through the heat generating elements 620*a*, 620*b*, the currents flow along the longitudinal direction of the substrate 610, the directions of the currents through the adjacent heat generating elements being substantially opposite to each other. The heat generating elements 620*a*, 620*b* as a second heat generating region adjacent the first heat generating region generate heat.

When voltage is applied between the electrical contact 641 and the electrical contact 661*b* through the connection between the heater 600 and the connector 700*a*, 700*b*, a potential difference is produced between the common electrode 642*f* and 642 *g* and the opposite electrode 662*b* through the common electroconductive line 640 and the opposite electroconductive line 660*b*. Therefore, through the heat generating elements 620*k*, 620*l*, the currents flow along the longitudinal direction of the substrate 610, the directions of the currents through the adjacent heat generating elements being substantially opposite to each other. By this, the heat generating elements 620*k*, 620*l* as a third heat generating region adjacent to the first heat generating region generate heat.

In this manner, by selecting the electrical contacts supplied with the voltage, the desired one or ones of the heat generating elements 620*a*-620*l* can be selectively energized.

[Connector]

Figure 7:
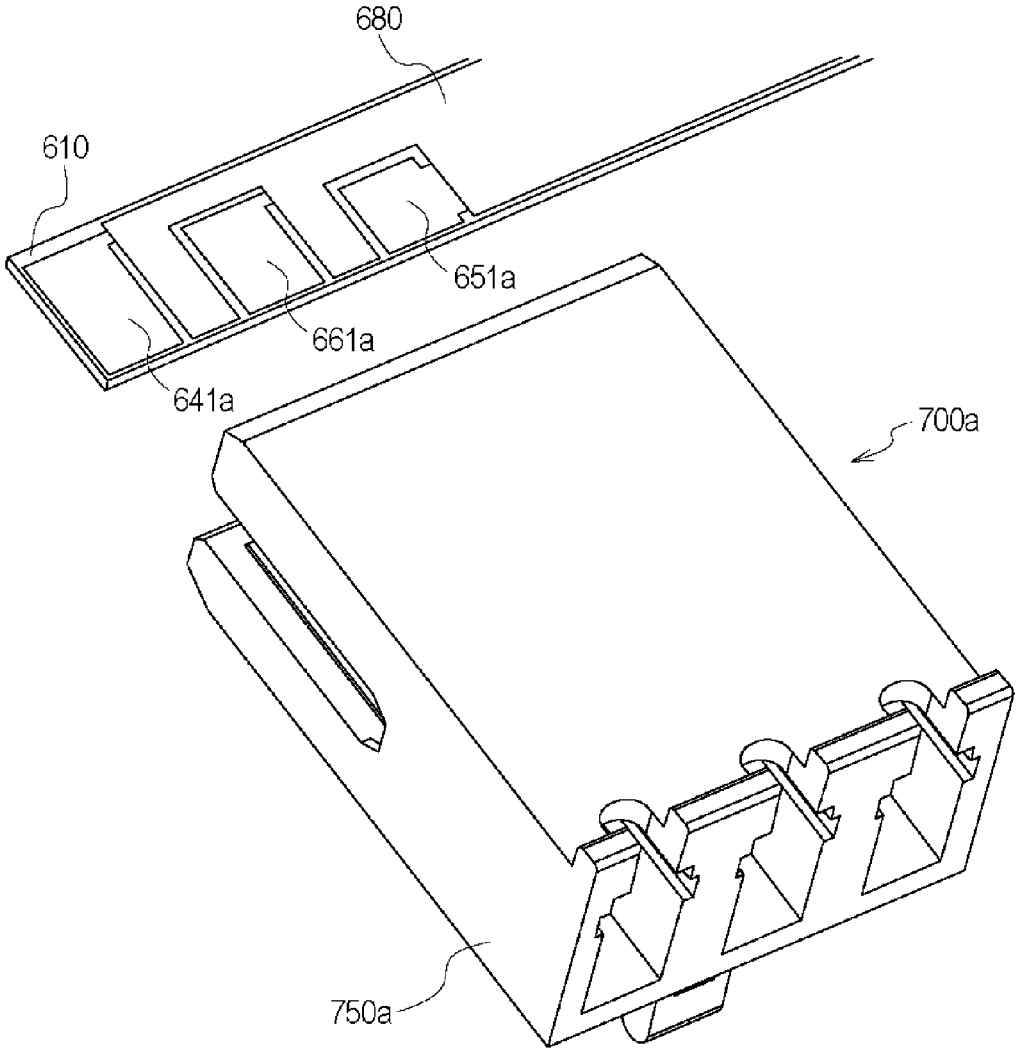
FIG. 7 illustrates a housing.
Figure 8:
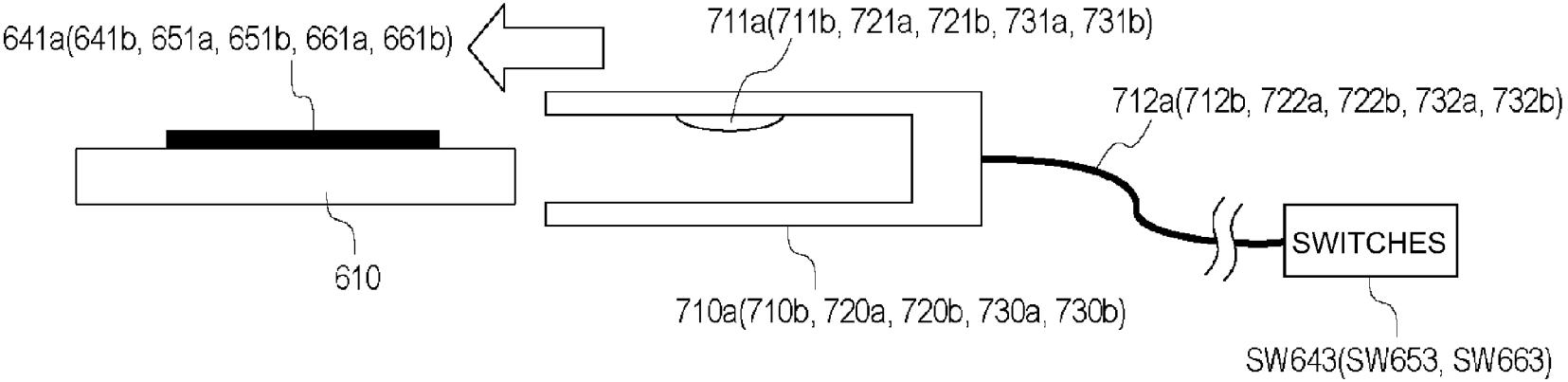
FIG. 8 illustrates a contact terminal
Figure 18:
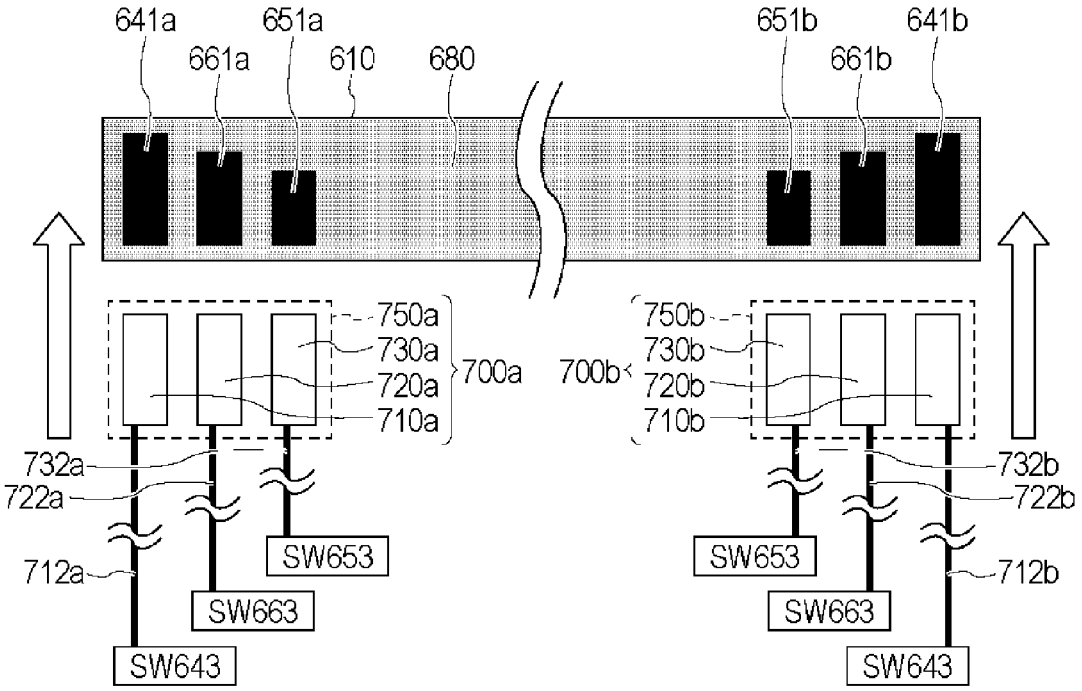
FIG. 18 illustrates mounting of a connector.

The connector 700*a*, 700*b* used with the fixing device 40 will be described in detail. FIG. 7 is an illustration of a housing 750*a*, 750*b*. FIG. 8 is an illustration of a contact terminal 710. FIG. 18 is an illustration of mounting method of the connector 700*a*, 700*b* to the heater 600. The connectors 700*a* and 700*b* of this embodiment are provided with contact terminals (which may be called terminal) 710*a*, 710*b*, 720*a*, 720*b*, 730*a*, 730*b*, and are electrically connected with the heater 600 by being mounted to the heater 600. More particularly, the connector 700*a* is provided with a terminal 710*a* electrically connectable with the electrical contact 641*a*, a terminal 720*a* electrically connectable with the electrical contact 661*a*, and a terminal 730*a* electrically connectable with the electrical contact 651*a*. The connector 700*b* is provided with a terminal 710*b* electrically connectable with the electrical contact 641*b*, a terminal 720*b* electrically connectable with the electrical contact 661*b*, and a terminal 730*b* electrically connectable with the electrical contact 651*b*. By the connectors 700*a*, 700*b* being mounted to the heater 600 to sandwich the heater 600, the terminals are connected with the corresponding electrical contacts. In the fixing device 40 of this embodiment having the above-described the structures, no soldering or the like is used for the electrical connection between the connectors and the electrical contacts. Therefore, the electrical connection between the heater 600 and the connector 700*a*, 700*b*, which rise in temperature during the fixing process operation, can be accomplished and maintained with high reliability. In the fixing device 40 of this embodiment, the connector 700*a*, 700*b* is detachably mountable relative to the heater 600, and therefore, the belt 603 and/or the heater 600 can be replaced without difficulty. The structure of the connector 700*a*, 700*b* will be described in detail.

As shown in FIG. 18, the connector 700*a* provided with the terminal 710*a*, 720*a*, 730*a* of metal is mounted to the heater 600 from the end portion of the substrate 610 with respect to the widthwise direction, in the one end portion side 610*a* of the substrate. The connector 700*b* provided with the terminals 710*b*, 720*b*, 730 is mounted to the heater 600 from the end portion of the substrate 610 with respect to the widthwise direction, in the other end portion side 610*b* of the substrate.

The terminals 710*a*, 720*a*, and 730*a* will be described taking the terminal 710*a* as an example. As shown in FIG. 8, the terminal 710*a* functions to electrically connect the electrical contact 641*a* and the switch SW643, which will be described hereinafter. The contact terminal 710*a* is provided with the electrical contact 711*a* for contacting to the electrical contact 641 and a cable 712*a* for the electrical connection with the switch SW643. The contact terminal 710*a* has a channel-like configuration, and by moving in the direction indicated by an arrow in FIG. 8, it can receive the heater 600. The portion of the connector 700*a* which contacts the electrical contact 641*a* is provided with the electrical contact 711*a* which contacts the electrical contact 641*a*, by which the electrical connection is established between the electrical contact 641*a* and the contact terminal 710*a*. The electrical contact 711*a* has a leaf spring property, and therefore, contacts the electrical contact 641*a* while pressing against it. Therefore, the contact 710*a* sandwiches the heater 600 between the front and back sides to fix the position of the heater 600.

Similarly, the contact terminal 710*b* functions to contact the electrical contact 641*b* with the switch SW643 which will be described hereinafter. The contact terminal 710*b* is provided with the electrical contact 711*b* for contacting to the electrical contact 641*b* and a cable 712*b* for the electrical connection with the switch SW643.

Similarly, the contact terminal (720*a*, 720*b*) functions to contact the electrical contact 661 (661*a*, 661*b*) with the switch SW663 which will be described hereinafter. The contact terminal (720*a*, 720*b*) is provided with the electrical contacts 721*a*, 721*b* for contacting to the electrical contact 661 and a cable 722*a*, 722*b* for the electrical connection with the switch SW663.

Similarly, the contact terminal (730*a*, 730*b*) functions to contact the electrical contact 651 (651*a*, 651*b*) which will be described hereinafter. The contact terminal (730*a*, 730*b*) is provided with the electrical contacts 731*a*, 731*b* for contacting to the electrical contact 651 and a cable 731*a*, 732*b* for the electrical connection with the switch SW653.

As shown in FIG. 7, the terminals 710*a*, 720*a*, 730*a* of metal are integrally supported by a housing 750*a* of resin material. The terminals 710*a*, 720*a*, 730*a* are disposed in the housing 750*a* with gaps between adjacent ones so as to connect with the electrical contacts 641*a*, 661*a*, and 651*a* when the connector 700*a* is mounted to the heater 600. Between the terminals, a partition is provided to assure the electrical insulation between the terminals.

The terminals 710*b*, 720*b*, 730*b* of metal are supported by the housing 750*a* of the resin material. The terminal 710*a*, 720*a*, 730*a* are disposed with a gap therebetween in the housing 750*b* so as to contact with the electrical contacts 641*b*, 661*b*, 651*b*, respectively, when the connector 700*b* is mounted to the heater. Between the terminals, a partition is provided to assure the electrical insulation between the terminals.

In this embodiment, the connector 700*a*, 700*b* is mounted in the widthwise direction of the substrate 610, but this mounting method is not limiting to the present invention. For example, the structure may be such that the connector 700*a*, 700*b* is mounted in the longitudinal direction of the substrate.

[Electric Energy Supply to Heater]

An electric energy supply method to the heater 600 will be described. The fixing device 40 of this embodiment is capable of changing a width of the heat generating region of the heater 600 by controlling the electric energy supply to the heater 600 in accordance with the width size of the sheet P. In the fixing device 40 of this embodiment, the sheet P is fed with the center of the sheet P aligned with the center of the fixing device 40, and therefore, the heat generating region extends from the center portion. The electric energy supply to the heater 600 will be described in conjunction with the accompanying drawings.

The electric energy supply circuit 110 is a circuit for supplying the electric power to the heater 600. In this embodiment, the commercial voltage source (AC voltage source) of approx. 100V in effective value (single phase AC). The electric energy supply circuit 110 of this embodiment is provided with a voltage source contact 110*a* and a voltage source contact 110*b* having different electric potentials. The electric energy supply circuit 110 may be DC voltage source if it has a function of supplying the electric power to the heater 600.

As shown in FIG. 5, the control circuit 100 is electrically connected with switch SW643, switch SW653, and switch SW663, respectively to control the switch SW643, switch SW653, and switch SW663, respectively.

Switch SW643 is a switch (relay) provided between the voltage source contact 110*a* and the electrical contact 641. The switch SW643 connects or disconnects between the voltage source contact 110*a* and the electrical contact 641 in accordance with the instructions from the control circuit 100. The switch SW653 is a switch provided between the voltage source contact 110*b* and the electrical contact 651. The switch SW653 connects or disconnects between the voltage source contact 110*a* and the electrical contact 651 in accordance with the instructions from the control circuit 100. The switch SW663 is a switch provided between the voltage source contact 110*b* and the electrical contact 661 (661*a*, 661*b*). The switch SW663 connects or disconnects between the voltage source contact 110*a* and the electrical contact 661 (661*a*, 661*b*) in accordance with the instructions from the control circuit 100.

When the control circuit 100 receives the execution instructions of a job, the control circuit 100 acquires the width size information of the sheet P to be subjected to the fixing process. In accordance with the width size information of the sheet P, a combination of ON/OFF of the switch SW643, the switch SW653, and the switch SW663 is controlled so that the heat generation width of the heat generating element 620 fits the sheet P. At this time, the control circuit 100, the electric energy supply circuit 110, the switch SW643, the switch SW653, the switch SW663 and the connector 700*a*, 700*b* function as an electric energy supplying means for supplying the electric power to the heater 600.

When the sheet P is a large size sheet (an usable maximum width size), that is, when A3 size sheet is fed in the longitudinal direction or when the A4 size is fed in the landscape fashion, the width of the sheet P is approx. 297 mm. Therefore, the control circuit 100 controls the electric power supply to provide the heat generation width B (FIG. 5) of the heat generating element 620. To effect this, the control circuit 100 renders ON all of the switch SW643, the switch SW653, and the switch SW663. As a result, the heater 600 is supplied with the electric power through the electrical contacts 641, 661*a*, 661*b*, 651, and all of the 12 sub-sections of the heat generating element 620 generate heat. At this time, the heater 600 generates the heat uniformly over the approx. 320 mm region to satisfy the heating requirements of the approx. 297 mm sheet P.

When the size of the sheet P is a small size (narrower than the maximum width), that is, when an A4 size sheet is fed longitudinally, or when an A5 size sheet is fed in the landscape fashion, the width of the sheet P is approx. 210 mm. Therefore, the control circuit 100 provides a heat generation width A (FIG. 5) of the heat generating element 620. Therefore, the control circuit 100 renders ON the switch SW643, and the switch SW663 and renders OFF the switch SW653. As a result, the heater 600 is supplied with the electric power through the electrical contacts 641, 651, so that 8 sub-sections of the 12 sub-sections of the heat generating element 620 generate heat. At this time, the heater 600 generates the heat uniformly over the approx. 213 mm region to satisfy the heat requirements for the approx. 210 mm sheet P.

[Arrangement of Electroconductive Lines]

Figure 9:
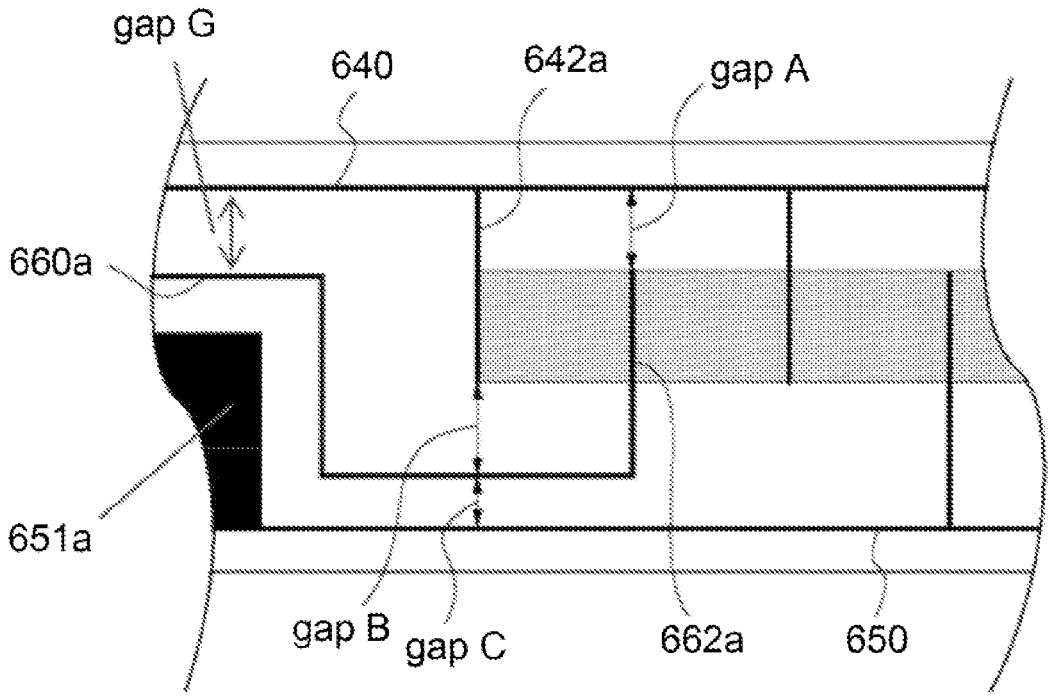
FIG. 9 is an illustration of the electroconductive lines on the substrate in Embodiment 1.

The arrangement of the electroconductive lines on the substrate 610 will be described the fixed. FIG. 9 illustrates the arrangement of the electroconductive lines on the substrate 610. As described hereinbefore, the heater 600 of this embodiment is provided with the common electroconductive line 640 connecting to the voltage source contact 110*a* in the one end portion side 610*d* of the substrate. All of the common electrodes 642 are connected with the common electroconductive line 640. On the other hand, the opposite electroconductive lines 650, 660 connecting to the voltage source contact 110*b* are provided in the other end portion side 610*e* of the substrate. The opposite electrode 652 is connected with the opposite electroconductive line 650, and the opposite electrode 662*a* is connected with the opposite electroconductive line 660*a*, and in addition, the opposite electrode 662*b* is connected with the opposite electroconductive line 660*b*. With this structure, the electroconductive line connecting to the different voltage source contacts are not positioned adjacent to each other, and therefore, the possibility of a short circuit between the electroconductive lines can be reduced. Therefore, the gap required to be provided between the electroconductive lines for preventing a short circuit can be reduced, so that the width of the substrate 610 can be reduced. A description will be provided in detail of this structure in conjunction with the accompanying drawings.

As shown in FIG. 9, the common electroconductive line 640 connected with the common electrode 642 and the electrical contact 641*a* extends in the longitudinal direction of the substrate 610. More particularly, in the central region 610*c* of the substrate 610, it extends substantially parallel with the heat generating element 620 adjacent thereto. Here, the phrase "substantially parallel" covers the case of not strictly "parallel with" because of the manufacturing tolerances of the electroconductive line formation.

As shown FIG. 9, in the one end portion side 610*d* of the substrate (FIG. 4), the common electroconductive line 640 is spaced from the heat generating element 620 and the opposite electrode by approx. 400 μm in the widthwise direction of the substrate 610. That is, a gap A of approx. 400 μm is provided between the heat generating element 620 and the common electroconductive line 640. The gap A is provided to assuredly insulate between the common electroconductive line 640 and the opposite electrode (662*a*, for example), and when the insulation coating layer 680 is provided, the minimum value of the gap is approx. 400 μm. The common electroconductive line 640 and the opposite electrode (662*a*, for example) are connected to different voltage source contacts (110*a* and 110*b*), and therefore, the gap A is relatively larger for safety. For this reason, the gap An is not satisfactory even if it is approx. 400 μm locally, but it is desirable that approx. 400 μm is assured over the entire area in which the heat generating element 620 and the common electroconductive line 640 extend substantially in parallel with each other.

The opposite electroconductive line 660*a* connecting with the opposite electrode 662*a* and the electrical contact 661*a*, and the opposite electroconductive line 660*b* connecting with the opposite electrode 662*b* and the electrical contact 661*b* extend along the longitudinal direction of the substrate 610. The opposite electroconductive lines 660*a*, 660*b* extend substantially with each other adjacent to the heat generating element 620 in the central region 610*c* (FIG. 4) of the substrate 610. In this embodiment, the opposite electroconductive lines 660*a*, 660*b* are spaced from the heat generating element 620 by approx. 400 μm in the widthwise direction of the substrate 610. That is, a gap B of approx. 400 μm is provided between the heat generating element 620 and the opposite electroconductive line 660. The gap B is provided to assure the insulation between the opposite electroconductive line 660 and the common electrode (642*a*, for example), and when the insulation coating layer 680 is provided, the minimum value of the gap is approx. 400 μm. The opposite electroconductive line 660 and the opposite electrode (642*a*, for example) are connected to different voltage source contacts (110*a* and 110*b*), and therefore, the gap B is relatively large for safety. For this reason, the gap B is not satisfactory even if it is approx. 400 μm locally, but it is desirable that approx. 400 μm is assured over the entire area in which the heat generating element 620 and the common electroconductive line 640 extend substantially in parallel with each other.

The opposite electroconductive line 650 connecting with the opposite electrode 652, the electrical contact 651*a*, and the electrical contact 651*b* extend along the longitudinal direction of the substrate 610. More particularly, in the central region 610*c* of the substrate 610, it extends parallel with and adjacent to the opposite electroconductive lines 660*a*, 660*b*. In this embodiment, the opposite electroconductive line 650 is spaced from the opposite electroconductive lines 660*a*, 660*b* by approx. 100 μm in the widthwise direction of the substrate 610. That is, a gap of approx. 100 μm is provided between the opposite electroconductive line 650 and the opposite electroconductive line 660*a*, 660*b*. The gap C is required for arranging the opposite electroconductive line 660 and the opposite electroconductive line 650 as separate electroconductive lines. The opposite electroconductive line 660 and the opposite electroconductive line 650 are connected to the same voltage source contact, and therefore, the gap C may be small. The width of the substrate 610 can be reduced by the amount of reduction of the gap C. For this reason, it will not suffice even if the gap C is less than gap A locally, but it is desirable that the gap C is less than gap A over the entire area in which the opposite electroconductive line 660 and the opposite electroconductive line 650 extend substantially in parallel with each other.

As shown in FIG. 9, in the one end portion side 610*a* of the substrate (FIG. 4) with respect to the longitudinal direction, the common electroconductive line 640, the opposite electroconductive line 660*a* and the electrical contact 651*a* are arranged in the widthwise direction of the substrate. The opposite electroconductive line 660*a* extends around the electrical contact 651*a* so as to be connected with the electrical contact 661*a* provided in the one end portion side of the substrate beyond the electrical contact 651*a* with respect to the longitudinal direction of the substrate. Here, a gap G between common electroconductive line 640 and the opposite electroconductive line 660*a* in the widthwise direction of the substrate is approx. 400 μm in this embodiment. The gap G is provided to assure the insulation between the common electroconductive line 640 and the opposite electroconductive line 660*a*, and when the insulation coating layer 680 is provided, the minimum value of the gap is approx. 400 μm. The common electroconductive line 640 and the opposite electroconductive line 660*a* are connected with different voltage source contacts (110*a* and 110*b*), and therefore, the gap G is relatively large for safety. For this reason, it is not satisfactory even if the gap G is approx. 400 μm locally, but it is desirable that the gap of approx. 400 μm is assured over the entire area in which the common electroconductive line 640 and the opposite electroconductive line 660*a* extend substantially in parallel with each other.

As described hereinbefore, in this embodiment, the electroconductive lines connecting to the same voltage source contact are adjacent to each other, and therefore, the gap between the electroconductive lines can be reduced. That is, gap G=gap A>gap C (gap B>gap C) are satisfied. Therefore the space required for the electroconductive lines on the substrate 610 can be reduced, and the upsizing of the substrate 610 attributable to the provision of the electroconductive lines on the substrate can be suppressed. Therefore, the manufacturing cost of the heater 600 can be reduced.

Embodiment 2

Figure 10:
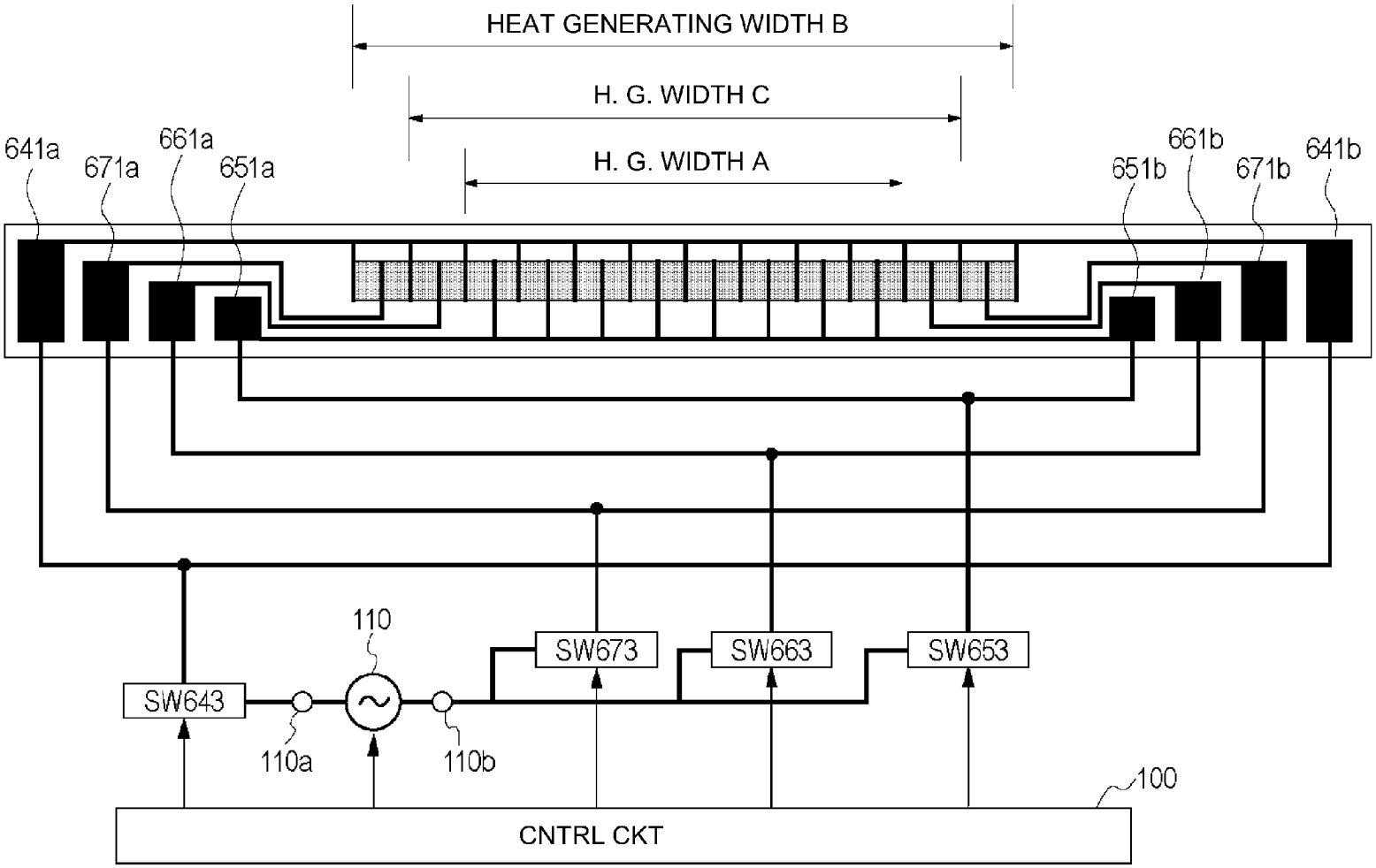
FIG. 10 illustrates the structural the relationship of the image heating apparatus according to an Embodiment 2.

A heater 600 according to Embodiment 2 of the present invention will be described. FIG. 10 is an illustration of a structure relation of the image heating apparatus of this embodiment. FIG. 11 illustrates the arrangement of the electroconductive lines on the substrate 610.

In Embodiment 1, the heat generation region of the heat generating element 620 is switched between a heat generation region A and a heat generation region B (Two patterns). In Embodiment 2, the heat generation region of the heat generating element 620 is switched between a heat generation region A, a heat generation region B and a heat generation region C. With this structure of this embodiment, the sheet P can be heated with more suitable heat generation widths for a variety of width sizes of the sheets. The structures of the fixing device 40 of Embodiment 2 are fundamentally the same as those of Embodiment 1 except for the structures relating to the heater 600. In the description of this embodiment, the same reference numerals as in Embodiment 1 are assigned to the elements having the corresponding functions in this embodiment, and the detailed description thereof is omitted for simplicity.

As shown in FIG. 10, the heater 600 of this embodiment can switch the heat generation region of the heat generating element 620 between the heat generation region A, the heat generation region B and the heat generation region C. The structure of the heater 600 of this embodiment will be described.

In this embodiment, the heat generating element 620 is divided into 12 sections by three common electrodes 642. Furthermore, each section is divided by two opposite electrodes provided in the middle portion thereof so that the heat generating element is divided 24 sub-sections. In this embodiment, a switch SW673 is provided in addition to the switch SW653 and switch SW663. On the substrate 610, an electrical contact 671 is provided in addition to the electrical contacts 641, 651, 661.

The electrical contact 671 (671*a*, 671*b*) contacts the terminal 740 (740*a*, 740*b*), by which it is electrically connected with the switch SW673. The switch SW673 is a switch provided between the voltage source contact 110*b* and the electrical contact 671. The switch SW673 connects or disconnects between the voltage source contact 110*a* and the electrical contact 671 in accordance with the instructions from the control circuit 100.

With such a structure, the heater 600 of this embodiment can switch the heat generation region of the heat generating element 620 between three patterns.

When the control circuit 100 receives the execution instructions of a job, the control circuit 100 acquires the width size information of the sheet P to be subjected to the fixing process. It controls the combination of ON/OFF of the switch SW643, the switch SW653, the switch SW663, and the switch SW673 in accordance with the width information of the sheet P so as to provide proper heat generation width for the sheet P.

When the sheet P is a large size sheet (longitudinal feeding of the A3 size sheet, for example, or lateral feeding of the A4 size sheet P), the control circuit 100 causes the heat generating element 620 to generate heat in the heat generation width B. To effect this, the control circuit 100 renders ON all of the switch SW643, the switch SW653, the switch SW663 and the switch SW673. At this time, the heater 600 generates the heat uniformly over the approx. 320 mm region to satisfy the heat requirements for the approx. 297 mm sheet P.

When the sheet P is a middle size sheet (longitudinal feeding of the B4 size sheet, lateral feeding of the B5 size sheet, for example), the width size of the sheet P is approx. 257 mm. Therefore, the control circuit 100 causes the heat generating element 620 to generate the heat in the heat generation width C. More particularly, the control circuit 100 renders ON the switch SW643, the switch SW653, and the switch SW663 and renders OFF the switch SW673. As a result, 20 sub-sections of the 24 sub-sections of the heat generating element 620 generate heat. At this time, the heater 600 generates heat uniformly in the range of approx. 267 mm, and therefore, it is suitable for heating the approx. 257 mm width sheet.

When the sheet P is a small size sheet (longitudinal feeding of the A4 size sheet, or lateral feeding of the A5 size, for example), the controller effect controlling to generate the heat on the heat generation width A. Therefore, the control circuit 100 renders ON the switch SW643, and the switch SW653 and renders OFF the switch SW673. A result, 16 sub-sections of the 24 sub-sections of the heat generating element 620 generate heat. At this time, the heater 600 generates the heat uniformly over the approx. 213 mm region to satisfy the heat requirements for the approx. 210 mm sheet P.

The arrangement of the electroconductive lines on the substrate 610 in this embodiment will be described. As shown in FIG. 11, the opposite electroconductive line 670*a* connected with the electrical contact 671*a* connected with the electrical contact 671*a* and the opposite electrode 672*a*, and the opposite electroconductive line 670*b* connected with the electrical contact 671*b* and the opposite electrode 672*b* extend along the longitudinal direction of the substrate 610. The opposite electroconductive lines 670*a*, 670*b* extend substantially with each other adjacent to the heat generating element 620 in the central region 610*c* (FIG. 4) of the substrate 610. In this embodiment, the opposite electroconductive lines 670*a*, 670*b* are spaced from the heat generating element 620 by approx. 400 μm in the widthwise direction of the substrate 610. That is, a gap B of approx. 400 μm is provided between the heat generating element 620 and the opposite electroconductive line 670. The gap B is provided to assure the insulation between the opposite electroconductive line 670 and the common electrode (642*a*, for example) by the insulation coating layer 680, and the minimum value is approx. 400 μm. The opposite electroconductive line 670 and the opposite electrode (642*a*, for example) are connected to different voltage source contacts (110*a* and 110*b*), and therefore, the gap B is relatively large for safety.

The opposite electroconductive line 660*a* connected with the electrical contact 661*a* and the opposite electrode 662*a*, and the opposite electroconductive line 660*b* connected with the electrical contact 661*b* and the opposite electrode 662*b* extend in the longitudinal direction of the substrate 610. In the central region 610*c* of the substrate 610, the opposite electroconductive line 660*a* extends substantially parallel with the opposite electroconductive line 670*a* adjacent thereto. In the central region 610*c* of the substrate 610, the opposite electroconductive line 660*b* extends substantially parallel with the opposite electroconductive line 670*b* adjacent thereto. In this embodiment, the opposite electroconductive line 660*a* is spaced from the opposite electroconductive lines 670*a* by approx. 100 μm in the widthwise direction of the substrate 610. The opposite electroconductive line 660*b* is disposed at the position approx. 100 μm away from the opposite electroconductive line 670*a* in the widthwise direction of the substrate 610. That is, a gap C of approx. 100 μm is provided between the opposite electroconductive line 670 and the opposite electroconductive line 660.

The gap C is required for arranging the opposite electroconductive line 670 and the opposite electroconductive line 660 as separate electroconductive lines. The opposite electroconductive line 660 and the opposite electroconductive line 650 are connected to the same voltage source contact, and therefore, the gap C may be small. The width of the substrate 610 can be reduced by the amount of the reduction of the gap C. For this reason, it will not suffice even if the gap C is less than gap A locally, but it is desirable that the gap C is less than gap A over the entire area in which the opposite electroconductive line 660 and the opposite electroconductive line 650 extend substantially in parallel with each other.

The opposite electroconductive line 650 connected with the opposite electrode 652, the electrical contact 651*a* and the electrical contact 651*b* extend along the longitudinal direction of the substrate 610. More particularly, in the central region 610*c* of the substrate 610, it extends parallel with and adjacent to the opposite electroconductive lines 660*a*, 660*b*. In this embodiment, the opposite electroconductive line 650 is spaced from the opposite electroconductive lines 660*a*, 660*b* by approx. 100 μm in the widthwise direction of the substrate 610. That is, a gap D of approx. 100 μm is provided between the opposite electroconductive line 650 and the opposite electroconductive line 660*a*, 660*b*.

The gap D is required for arranging the opposite electroconductive line 660 and the opposite electroconductive line 650 as separate electroconductive lines. The opposite electroconductive line 660 and the opposite electroconductive line 650 are connected to the same voltage source contact, and therefore, the gap C may be small. The width of the substrate 610 can be reduced by the amount of reduction of the gap C. For this reason, it will not suffice even if the gap C is less than gap A locally, but it is desirable that the gap C is less than gap A over the entire area in which the opposite electroconductive line 660 and the opposite electroconductive line 650 extend substantially in parallel with each other.

Figure 16:
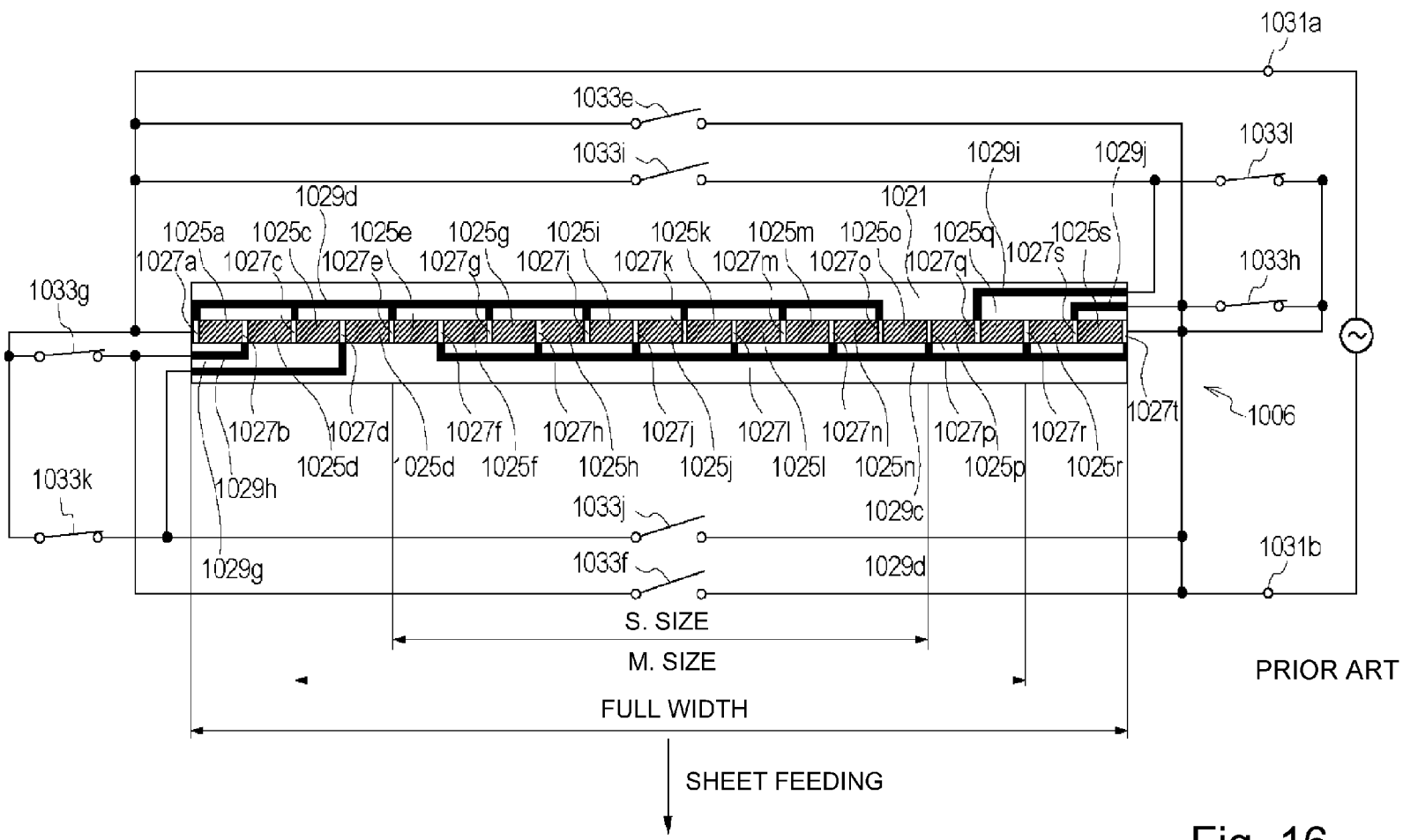
FIG. 16 is a circuit diagram of a conventional heater.

A comparison example will be explained, as compared with this embodiment. FIG. 16 is a circuit diagram of the heat generating element of conventional example 1 disclosed in Japanese Laid-open Patent Application 2012-37613. In conventional example 1, an electroconductive line layer 1029 *g* and an electroconductive line layer 1029*h* are juxtaposed in the widthwise direction of the substrate 1021. In addition, an electroconductive line layer 1029*i* and an electroconductive line layer 1029*j* are juxtaposed in the widthwise direction of the substrate 1021. The electroconductive line layer 1029 *g* and the electroconductive line layer 1029*h* are connected with different voltage source contacts, and the electroconductive line layer 1029*i* and the electroconductive line layer 1029*j* are connected with different voltage source contacts. Therefore, a large potential difference is produced between the electroconductive line layer 1029 *g* and the electroconductive line layer 1029*h*, and between the electroconductive line layer 1029*i* and the electroconductive line layer 1029*j*. Therefore, for the prevention of a short circuit between the electroconductive lines, a large gap is preferably provided between the electroconductive line layer 1029 *g* and the electroconductive line layer 1029*h* and also between the electroconductive line layer 1029*i* and the electroconductive line layer 1029*j*.

In the conventional example 1, if the gap between the electroconductive lines connected to the different voltage source contacts is approx. 400 μm, this embodiment is effective to reduce the width of the space required for the electroconductive lines in the widthwise direction by approx. 600 μm.

In the case of the heater 600 with which the heat generation region of the heat generating element 620 is switchable between three patterns as in this embodiment, the number of the electroconductive lines arranged in the widthwise direction on the substrate 610 is larger than in Embodiment 1. That is, the increase of the number of the patterns of the heat generation region results in the increase of the number of the electroconductive lines arranged in the widthwise direction on the substrate 610. Therefore, the increase of the patterns of the heat generation region of the heat generating element 620 leads to a sizing of the substrate 610 in the widthwise direction. However, according to this embodiment, the increased electroconductive lines are all connected to the same voltage source contact, and therefore, the gaps between the electroconductive lines can be reduced. In this embodiment, gap A>gap C=gap D (gap B>gap C=gap D) are satisfied. Therefore, the increase of the size of the substrate 610 in the widthwise direction attributable to the additional electroconductive lines on the substrate can be reduced. This applies to the case where the number of the patterns of the heat generation region of the heat generating element 620 is 4 or more.

According to this embodiment, even if the number of the patterns of the switchable heat generating region increases with the result of the increase of the number of the electroconductive lines on the substrate, the width increase of the substrate 610 can be minimized.

Embodiment 3

Figure 13:
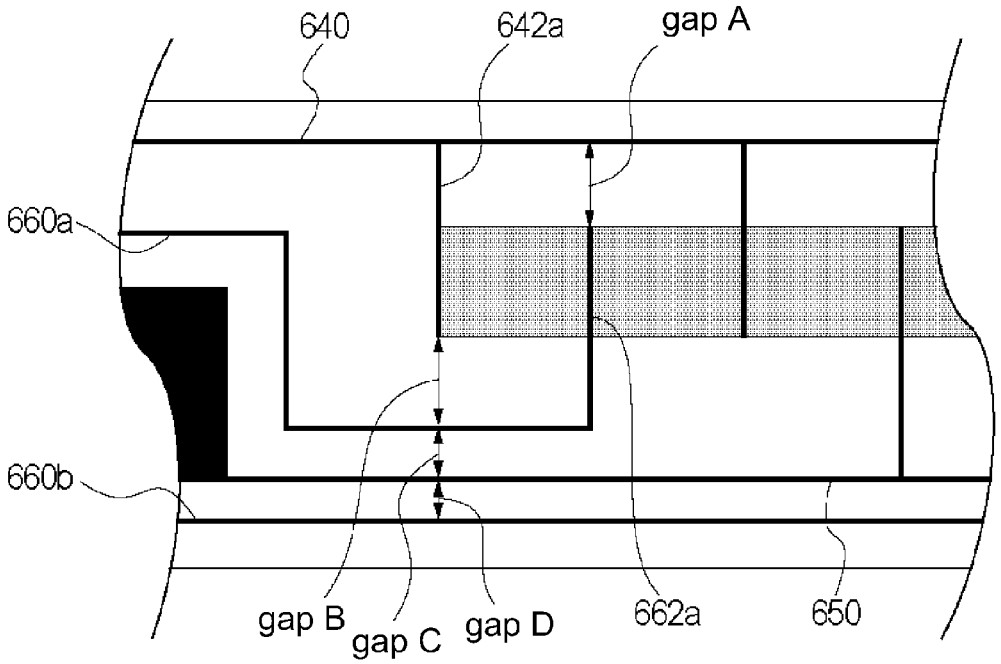
FIG. 13 is an illustration of the electroconductive lines on the substrate in Embodiment 1.

A heater according to Embodiment 3 of the present invention will be described. FIG. 12 is an illustration of a structure relation of the image heating apparatus of this embodiment. FIG. 13 illustrates an arrangement of the electroconductive lines on the heater of this embodiment. In Embodiment 1, the heat generating element 620 is supplied with the electric energy from the electrical contacts disposed in the opposite longitudinal end portions of the substrate 610. In Embodiment 3, the heat generating element 620 it is supplied with the electric energy from the electrical contacts provided one longitudinal end portion of the substrate 610. More particularly, the electrical contact 661*b* and the electrical contact 661*a* of Embodiment 1 are gathered into a common electrical contact 661*a*. The 651*b* electrical contact is gathered into the electrical contact 651*a*. The 651*b* electrical contact is gathered into the electrical contact 651*a*. With such a structure, the number of electrical contacts on the substrate 610 can be reduced. A description will be provided in detail in conjunction with the accompanying drawings. The structures of the fixing device 40 of Embodiment 3 are fundamentally the same as those of Embodiment 1 except for the structures relating to the heater 600. In the description of this embodiment, the same reference numerals as in Embodiment 1 are assigned to the elements having the corresponding functions in this embodiment, and the detailed description thereof is omitted for simplicity.

The arrangement of the electroconductive lines on the substrate 610 in this embodiment will be described. As shown in FIG. 12, in the heater 600 of this embodiment, the electric energy supply to the heat generating element 620 is effected by the electrical contacts 641*a*, 651*a*, 661*a* provided in the one end portion side of the substrate 610 with respect to the longitudinal direction. The common electroconductive line 640 extends along the longitudinal direction of substrate 610 toward the one end portion side 610*a* of the substrate, in the one end portion side of the substrate 610 with respect to the longitudinal direction. An end of the common electroconductive line 640 is connected to the electrical contact 641*a*. With this structure, the electrical contacts 641*a*, 641*b* in Embodiment 1 are gathered into a single electrical contact, by which one electrical contact is omitted.

The opposite electroconductive line 650 extends along the longitudinal direction of the substrate 610 toward the one end portion side 610*a* of the substrate in another end portion side with respect to the widthwise direction substrate 610 beyond the heat generating element 620. The opposite electroconductive line 650 is connected to the electrical contact 651*a*. With this structure, the electrical contacts 651*a*, 651*b* in Embodiment 1 is gathered into a single electrical contact, by which one electrical contact is omitted.

The opposite electroconductive line 660*a* extends along the longitudinal direction of the substrate 610 toward the one end portion side 610*a* of the substrate in another end portion side with respect to the widthwise direction substrate 610 beyond the heat generating element 620. An end of the opposite electroconductive line 660*a* is connected with the electrical contact 661*a*. The opposite electroconductive line 660*b* extends along the longitudinal direction of the substrate 610 toward the one end portion side 610*a* of the substrate in another end portion side with respect to the widthwise direction substrate 610 beyond the heat generating element 620. An end of the opposite electroconductive line 660*b* is connected with the electrical contact 661*a*. The opposite electroconductive lines 660*a* and 660*b* surround the electrical contact 651*a* in the one end portion side of the substrate 610 with respect to the longitudinal direction. With the above-described structure, the electrical contact 661*b* of Embodiment 1 can be gathered into the single electrical contact 661*a*.

In the foregoing examples, three electrical contacts can be omitted as compared with Embodiment 1, and therefore, the length of the substrate 610 can be reduced by approx. 9 mm. In Embodiment 1, the gap of approx. 26 mm between the common electrode 642 *g* and the electrical contact 651*b* in the longitudinal direction can be omitted. The gap is required mechanically when the connector 700*a*, 700*b* is mounted to the heater 600 provided in the belt 603.

With this structure in which the electric energy is supplied from one end portion side of the substrate as described above, the potential is asymmetrical in the longitudinal direction of the common electroconductive line 640 (between the one end portion side and the other end portion side with respect to the longitudinal direction). This is because a voltage drop is produced by the resistance of the electroconductive line per se. By the voltage drop attributable to the electroconductive line per se, the electric power supplied to the heat generating element 620 is asymmetrical in the longitudinal direction, with the possible result of non-uniformity heat generation of the heat generating element 620.

In consideration of the heat generation non-uniformity of the heat generating element 620, a symmetrical arrangement of Embodiment 1 is preferable. However, the voltage drop attributable to the resistance of the electroconductive line is so small that it is negligible in the fixing process operation. Therefore, in this embodiment, the electric energy supply to the heater is effected from one end portion side 610*a* of the substrate.

The opposite electroconductive line 660*a* connected to the electrical contact 661*a* and the opposite electrode 662*a* extend in the longitudinal direction of the substrate 610. In the central region 610*c* of the substrate 610, the opposite electroconductive line 670*a* extends substantially parallel with the heat generating element 620 adjacent thereto. In this embodiment, the opposite electroconductive line 670*a* is spaced away from the heat generating element 620 by approx. 400 μm in the widthwise direction of the substrate 610. That is, a gap B of approx. 400 μm is provided between the heat generating element 620 and the opposite electroconductive line 660. The gap B is provided to assure the insulation between the opposite electroconductive line 670 and the common electrode (642*a*, for example), and when the insulation coating layer 680 is provided, it is approx. 400 μm. The opposite electroconductive line 670 and the opposite electrode (642*a*, for example) are connected to different voltage source contacts (110*a* and 110*b*), and therefore, the gap B is relatively large for safety.

The opposite electroconductive line 660*a* connected to the electrical contact 651*a* and the opposite electrode 652*a* extend in the longitudinal direction of the substrate 610. In the central region 610*c* of the substrate 610, the opposite electroconductive line 650 extend substantially parallel with the opposite electroconductive line 660*a* adjacent thereto. In this embodiment, the opposite electroconductive line 650 is spaced from the opposite electroconductive lines 660*a* by approx. 100 μm in the widthwise direction of the substrate 610. That is, a gap of approx. 100 μm is provided between the opposite electroconductive line 670 and the opposite electroconductive line 660*a*, 660*b*.

The gap C is required for arranging the opposite electroconductive line 670 and the opposite electroconductive line 660 as separate electroconductive lines. The opposite electroconductive line 660*a* and the opposite electroconductive line 650 are connected to the same voltage source contact, and therefore, the gap C can be made small. The width of the substrate 610 can be reduced by the amount of the reduction of the gap C. For this reason, it will not suffice even if the gap C is less than gap A locally, but it is desirable that the gap C is less than gap A over the entire area in which the opposite electroconductive line 660 and the opposite electroconductive line 650 extend substantially in parallel with each other.

The opposite electroconductive line 660*b* connected to the electrical contact 651*a* and the opposite electrode 662*b* extend in the longitudinal direction of the substrate 610. More particularly, in the central region 610*c* of the substrate 610 (FIG. 4), it extends substantially parallel with the opposite electroconductive line 650 adjacent thereto. In this embodiment, the opposite electroconductive line 660*b* is spaced from the opposite electroconductive lines 650 by approx. 100 μm in the widthwise direction of the substrate 610. That is, a gap of approx. 100 μm is provided between the opposite electroconductive line 650 and the opposite electroconductive line 660*a*, 660*b*.

The gap D is required for arranging the opposite electroconductive line 660 and the opposite electroconductive line 650 as separate electroconductive lines. The opposite electroconductive line 660 and the opposite electroconductive line 650 are connected to the same voltage source contact, and therefore, the gap C may be small. The width of the substrate 610 can be reduced by the amount of the reduction of the gap C. For this reason, it will not suffice even if the gap C is less than gap A locally, but it is desirable that the gap C is less than gap A over the entire area in which the opposite electroconductive line 660 and the opposite electroconductive line 650 extend substantially in parallel with each other.

In the case that a single electrical contact 641*a* contacts to the plurality of heat generating elements 620*a*, 620*b*, 620*k* and 620*l* distributed in the longitudinal direction of the longitudinal direction of the heat generating element 620 as in this embodiment, the number of the electroconductive lines arranged in the widthwise direction on the substrate 610 is larger than that in Embodiment 1. If an attempt is made to gather the electrical contacts into a single electrical contact, the number of the electroconductive lines arranged in the widthwise direction of the substrate 610 increases. However, in this embodiment, the additional electroconductive lines are all connected with the same voltage source contact, and therefore, the gaps can be reduced. In this embodiment, gap A>gap C=gap D (gap B>gap C=gap D) are satisfied. Therefore, the increase of the width of the substrate 610 can be suppressed.

According to this embodiment, even if a plurality of heat generating elements is gathered into a single electrical contact with the result of the increase of the number of electroconductive lines, the gaps between the electroconductive lines can be reduced. Therefore, the increase of the size of the substrate 610 in the widthwise direction attributable to the additional electroconductive lines on the substrate can be reduced. This embodiment can be applied to Embodiment 2 as well as Embodiment 1.

Embodiment 4

Figure 14:
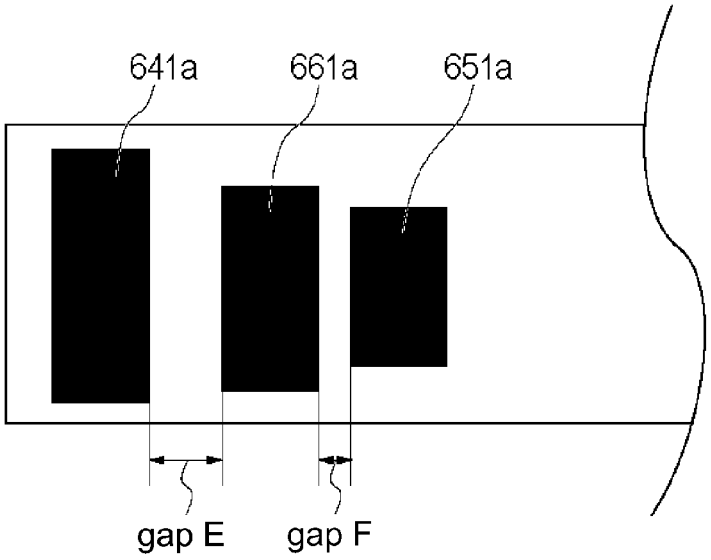
FIG. 14 is an illustration of the electroconductive lines on the substrate in Embodiment 4.

A heater according to Embodiment 4 of the present invention will be described. FIG. 14 illustrates an arrangement of the electroconductive lines on the heater of this embodiment. In Embodiment 3, in the one end portion side of the substrate 610 with respect to the longitudinal direction, the electrical contacts are arranged in the longitudinal direction of the substrate 610 at regular intervals, and the increase of the length of the substrate 610 is suppressed by reducing the number of the electrical contacts. On the other hand, in this embodiment, the distance between the electrical contacts 651*a*, 661*a* connected to the same voltage source contact is reduced, in addition to the structure of Embodiment 3. With such a structure, the area on the substrate 610 required by the provision of the electrical contacts can be reduced, and therefore, the upsizing of the substrate 610 in the longitudinal direction can be further suppressed. A description will be provided in detail in conjunction with the accompanying drawings. The structures of the fixing device 40 of Embodiment 4 are fundamentally the same as those of Embodiment 3 except for the structures relating to the heater 600. In the description of this embodiment, the same reference numerals as in Embodiment 3 are assigned to the elements having the corresponding functions in this embodiment, and the detailed description thereof is omitted for simplicity.

The electrical contacts 641*a*, 651*a*, 661*a* are not coated with the insulation coating layer 680, and the surfaces thereof are exposed, and therefore, it is desirable to provide an insulation distance to assure the prevention of the leakage and/or a short circuit. With the increase of the insulation distance, the possibility of the leakage and/or a short circuit decreases, but on the other hand, when the electrical contacts are arranged in the longitudinal direction in Embodiment 1, the length of the substrate 610 increases. Therefore, it is preferable to provide a proper gap between adjacent electrical contacts.

In this embodiment, the electrical contact 641 is connected to the voltage source contact 110*a*, and the electrical contact 661*a* is connected to the voltage source contact 110*b*. That is, the electrical contacts 641*a* and 661*a* are connected to different voltage source contacts. Therefore, a short circuit due to the creepage discharge tends to occur between the electrical contacts 641*a* and 661*a*. Therefore, between the electrical contact 641 and the electrical contact 661, a gap (gap E) of not less than 2.5 mm which is the insulation distance for preventing a short circuit is preferably provided. In this embodiment, the gap E is approx. 4 mm in consideration of the mounting tolerances of the connector 700*a*, 700*b* and/or the thermal expansion of the substrate 610. When the gap between the electrical contacts 641*a* and 661*a* is not constant because of non-parallelism between the electrical contacts 641*a* and 661*a*, a minimum value of the gap is deemed as the gap E.

In this embodiment, the electrical contacts 651*a*, 661*b* are connected to the voltage source contact 110*b*. Therefore, the electrical contacts 61*a* and 661*a* are connected with the same voltage source contact. Therefore, a short circuit due to the creepage discharge hardly occurs between the electrical contacts 641*a* and 661*a* (gap F). Therefore, the insulation distance for preventing the creepage discharge is not taken into account in the case of the gap F. However, in consideration of the mounting tolerances of the connector 700*a*, 700*b* and/or the thermal expansion of the substrate 610, the gap F is approx. 1.5 mm in this embodiment. When the gap between the electrical contacts 641*a* and 661*a* is not constant because of non-parallelism between the electrical contacts 641*a* and 661*a*, a minimum value of the gap is deemed as the gap E.

From the stand point of the electrical contact 661*a*, this means the following. In the one end portion side, the electrical contact 661*a* as a third electrical contact and the electrical contact 641*a* as a first electrical contact are adjacent to each other in the longitudinal direction of the substrate 610. The gap between the electrical contact 661*a* and the electrical contact 651*a* (approx. 1.5 mm in this embodiment) is less than the gap between the electrical contact 661 and the electrical contact 641*a* (approx. 4 mm in this embodiment). That is, gap E>gap F is satisfied. These components are arranged such that the gap between the electrical contact 661*a* and the electrical contact 651*a* is less than gap E over their entirety, so that the length of the substrate can be reduced.

The order of the electrical contacts is not limited to that described above. For example, the electrical contact 641*a* may be disposed at a position closer to the central region 610*c* of the substrate 610*a*. However, the electrical contact 641*a* connects with the voltage source contact (110*a*), which is different from the voltage source contact (110*b*) to which the other electrical contacts connect. Therefore, it is preferable that the electrical contact 641*a* is disposed at an end of an array of the electrical contacts.

Figure 15:
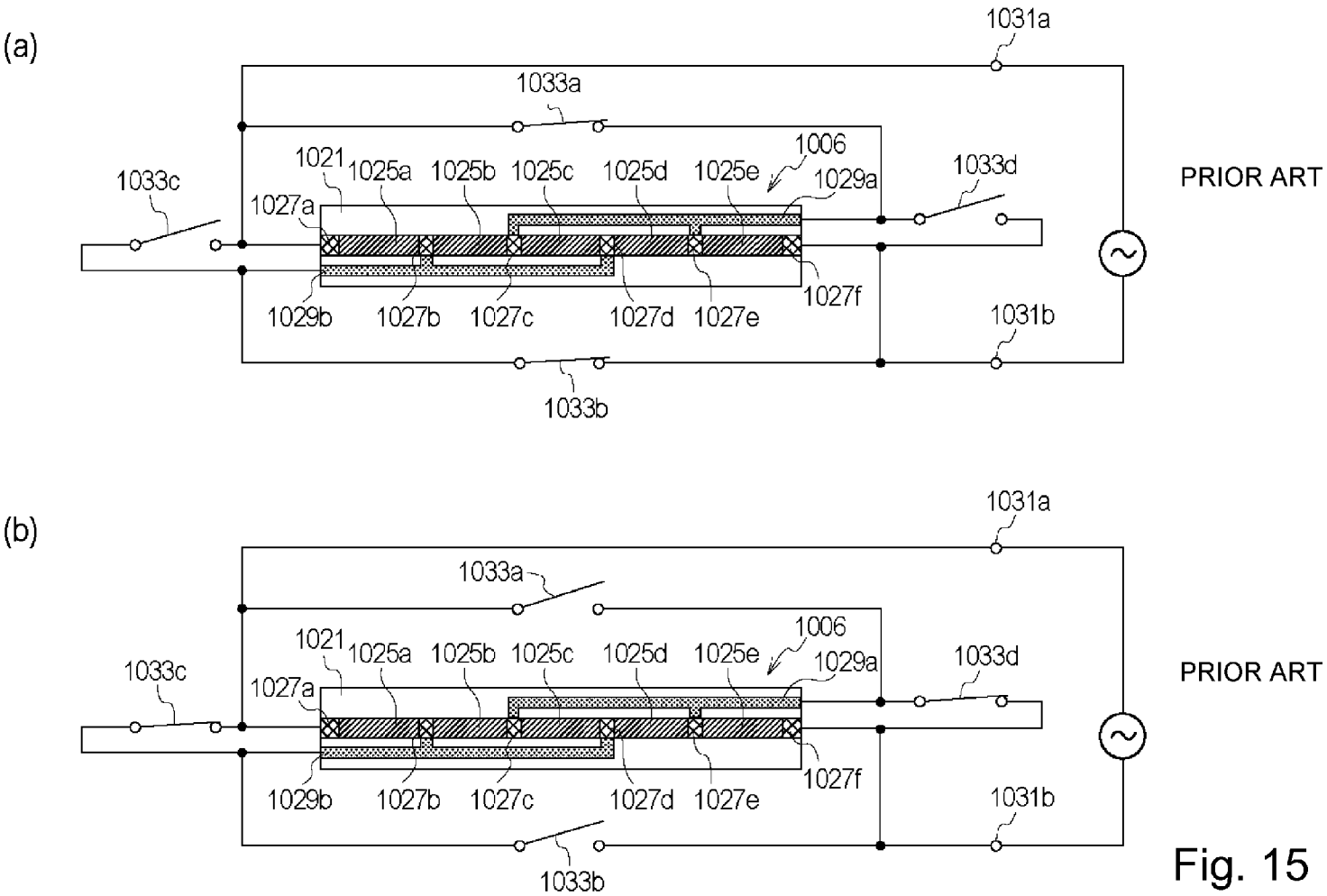
FIG. 15 is a circuit diagram of a conventional heater.

A comparison will be made between Embodiment 4 and a conventional example. FIG. 15 is a circuit diagram of the heater of conventional example 2 disclosed in Japanese Laid-open Patent Application 2012-37613. FIG. 16 is a circuit diagram of the heater of conventional example 1 described above. The heater 1006 of conventional example 2 is openable with two heat generating regions, wherein the arrangement of the electroconductive lines is different from that of Embodiment 1. The heater 1006 of conventional example 1 of FIG. 16 is openable with three heat generating regions, wherein the arrangement of the electroconductive lines is different from Embodiment 2.

In FIGS. 15 and 16, the electroconductive line layer 1029 connected to the electrodes 1025 extends to the longitudinal end portion of the substrate 1021. In the end portion of the substrate 1021, the electroconductive lines are exposed, and are connectable with voltage source contacts 1031 using the electroconductive line terminal (unshown). With this structure shown in FIGS. 15 and 16, the portions corresponding to the electrical contact of this embodiment are arranged in the widthwise direction of the substrate 1021 in the opposite end portions of the substrate 1021.

With such an arrangement, it is difficult to effect the electric power supply with the assured prevention of a short circuit when the width of the substrate 610 is small as in this embodiment. Therefore, the comparison with this embodiment will be made on the basis of the heater 1006 using the electroconductive line arrangement according to conventional example 1, and conventional example 2, installed in the fixing device 40 having the same structure as in this embodiment. More specifically, in comparison example 1, the heater of the conventional example 2 is modified such that in the opposite longitudinal end portions, the electrical contacts are arranged in the longitudinal direction of the substrate. In comparison example 2, the heater of the conventional example 1 is modified such that in the opposite longitudinal end portions, the electrical contacts are arranged in the longitudinal direction of the substrate.

The arranging of the electrical contacts in the comparison example 1 and comparison example 2 is the same as that of the present invention. That is, the electrical contacts which can be gathered are gathered, and the gap between the electrical contacts which can be reduced are reduced.

In the heater of comparison example 1, the electroconductive lines are provided so as to be openable with two different width sheets. In the heater of comparison example 1, when the heat generating element generates heat for a large width sheet, an electroconductive line layer 1029*c* and an electroconductive line layer 1029*e* are connected with a voltage source contact 1031*a*, and an electroconductive line layer 1029*f* and an electroconductive line layer 1029*d* are connected with a voltage source contact 1031*b*, as shown in part (a) of FIG. 15. In the heater of conventional example 1, when the heat generating element generates heat for a small width sheet, an electroconductive line layer 1029*c* and an electroconductive line layer 1029*f* are connected with a voltage source contact 1031*a*, and an electroconductive line layer 1029*e* and an electroconductive line layer 1029*d* are connected with a voltage source contact 1031*b*, as shown in part (b) of FIG. 15. Therefore, the electroconductive line layers 1029*c*, 1029*d*, 1029*e*, 1029*f* are connected with different voltage source contacts. The electrical contacts (unshown) connected with the electroconductive line layers 1029*c*, 1029*d*, 1029*e*, 1029*f* are connected with different voltage source contacts.

In comparison example 1, it is difficult to make a plurality of electroconductive lines into a single electrical contact as in this embodiment or Embodiment 3. In addition, it is also difficult to reduce the gaps between the electrical contacts as in this embodiment.

Therefore, the width of the region for an array of the electrical contact in the longitudinal range of the substrate 610 is approx. 24 mm (four approx. 3 mm electrical contacts plus two gaps of approx. 4 mm between the adjacent electrical contacts.

The heater of comparison example 2 is provided with electroconductive lines arranged so that the heater is openable with three width sheets (large, middle, and small). In the heater of comparison example 2, electroconductive line layers 1029*c*, 1029*d*, 1029*g*, 1029*h*, 1029*i*, 1029*j* are connected with different voltage source contacts. Therefore, the electrical contacts (unshown) connected with the electroconductive line layers 1029*c*, 1029*d*, 1029*g*, 1029*h*, 1029*i*, 1029*j* are also connected with different voltage source contacts.

In comparison example 2, it is difficult to make a plurality of electroconductive lines into a single electrical contact as in this embodiment or Embodiment 3. In addition, it is also difficult to reduce the gaps between the electrical contacts as in this embodiment.

Therefore, the width of the region for an array of the electrical contact in the longitudinal range of the substrate 610 is approx. 34 mm (six approx. 3 mm electrical contacts plus four gaps of approx. 4 mm between the adjacent electrical contacts.

On the other hand, in the case of the heater in this embodiment which is operable with sheets of two different widths, the width of the array of the electrical contacts in the lines to a range of the substrate 610 is as follows. It is approx. 24 mm (three approx. 3 mm electrical contacts, one gap for an approx. 4 mm electrical contact, and one gap for approx. 1.5 mm electrical contact.

On the other hand, in the case of the heater in this embodiment which is operable with sheets of three different widths, the width of the array of the electrical contacts in the lines to a range of the substrate 610 is as follows. It is approx. 19 mm (four approx. 3 mm electrical contacts, the gap for an approx. 4 mm electrical contact, and two gaps for approx. 1.5 mm electrical contacts.

The results of the above analysis are shown in Table 1. In the Table, the heater operable with two heat generating regions is Embodiment 4a, and the heater operable with three heat generating regions is Embodiment 4b.

TABLE 1

| | Emb. 4a | Comp. Ex. 1 | Emb. 4b | Comp. Ex. 2 |
|---|---|---|---|---|
| Number of heat generating region pattern | 2 | 2 | 3 | 3 |
| Number of electrodes | 3 | 4 | 4 | 6 |
| Total width of electrode portions | 14.5 mm | 24 mm | 19 mm | 34 mm |

As will be understood from Table 1, and other conditions that the numbers of the heat generation region patterns are the same, the number of electrical contacts is smaller in this embodiment than in the conventional examples. Therefore, the structure relating to the electrical contacts can be simplified.

Since the number of the electrical contacts connected to the same voltage source contact is large, the gaps between the adjacent electrical contacts can be reduced when the electrical contacts are arranged in the longitudinal direction of the substrate 610. For this reason, the total width of the arrays of the electrical contacts (total width including the widths of the electrical contacts and the gaps) can be reduced, and therefore, the increase of the length of the substrate 610 can be suppressed when the electrical contacts are arranged in an array. In addition, the size of the connector 700*a*, 700*b* can be reduced.

When the length of the substrate 610 is fixed, a larger number of patterns of the heat generation regions can be provided in this embodiment than in the formation of the examples.

In the foregoing, the length of the substrate 610 is further reduced as compared with Embodiment 3, but the present invention is not limited to such a case. The present invention is applicable if in one end portion side 610*a* of the substrate, a plurality of electrical contacts connected to the voltage source contact (110*b*) are arranged in the longitudinal direction of the substrate 610.

For example, the present invention is applicable in the case in which in the one end portion side 610*a* of the substrate three electrical contacts are arranged in the longitudinal direction of the substrate 610, and the two electrical contacts of the three electrical contacts are connected to the same voltage source contact. More particularly, the electrical contact (641*a*, for example) connected to the voltage source contact 110*a* is disposed adjacent to one end of the electrical contact (661*a*, for example) connected to the voltage source contact 110*b*. In addition, the electrical contact (651*a*, for example) connected to the voltage source contact 110*b* is disposed adjacent to the other end portion side of the electrical contact (661*a*) connected to the voltage source contact 110*b*.

Therefore, the structure of this embodiment is applicable to the structures of Embodiments 1 and 2. For example, in Embodiment 1, the gap between the electrical contact 661*a* (661*b*) and the electrical contact 651*a* (651*b*) can be made smaller than the gap between the electrical contact 641*a* (641*b*) and the electrical contact 661*a* (651*b*). Therefore in Embodiment 1 and Embodiment 2, the width of the arrays of the electrical contacts can be reduced in each of one and the other end portions of the substrate. Therefore, the length of the substrate 610 can be reduced.

In addition, this embodiment is applicable if two electrical contacts connected to different voltage source contacts are provided in the one end portion side 610*a* of the substrate, and two electrical contacts connected to the same voltage source contact are provided in the other end portion side 610*b* of the substrate. Here, the gap between the two electrical contacts connected to the same voltage source contact in the other end portion side 610*b* of the substrate can be made smaller than the gap between the two electrical contacts connected to the different voltage source contacts in the one end portion side 610*a* of the substrate.

In addition, this embodiment is applicable if the electrical contact connected to the voltage source contact 110*a* and provided in the one end portion side 610*a* of the substrate, and two electrical contacts connected to the voltage source contact 110*b* and provided in the other end portion side 610*b* of the substrate are arranged in the longitudinal direction. In this case, the gap between the two electrical contacts connected to the voltage source contact 110*b* and the provided in the other end portion side 610*b* of the substrate is less than 2.5 mm.

In this embodiment, the electrical contacts are arranged in the longitudinal direction of the substrate 610, and the electrical contacts are not arranged in the widthwise direction of the substrate, for the purpose of preventing an increase of the width of the substrate. However, in this embodiment, an electrical contact connected to the same voltage source contact can be disposed with a reduced gap.

Therefore, even if the electrical contacts 661*a* and 671*a* of Embodiment 2 are arranged in the widthwise direction, this embodiment is applicable.

Therefore, the electrical contact (641*a*, for example) connected to the voltage source contact 110*a* is disposed adjacent to one end portion side of the electrical contact (661*a*, for example) connected to the voltage source contact 110*b* with respect to the longitudinal direction. The electrical contact (651*a*, for example) connected to the voltage source contact 110*b* is provided in the other end portion side of the electrical contact (662*a*, for example) connected to the voltage source contact 110*b* with respect to the longitudinal direction. The electrical contact (671*a*, for example) connected to the voltage source contact 110*b* is disposed adjacent to the other end portion side of the electrical contact (661*a*, for example) connected to the voltage source contact 110*b* with respect to the widthwise direction. With such an arrangement, the gap between the electrical contact 661*a* (661*b*) and the electrical contact 651*a* (661*b*) can be made smaller than the gap between the electrical contact 641*a* (641*b*) and the electrical contact 661*a* (651*b*). In addition, the gap between the electrical contact 671*a* and the electrical contact 651*a* can be made smaller than the gap between the electrical contact 641*a* and the electrical contact 671*a*.

The heater per se of the foregoing embodiments can be summarized as follows:

A heater comprising:

a substrate;

a plurality of electrode portions including a plurality of first electrode portions electrically connectable with one of a grounding and non-grounding side of an electric power source and a plurality of second electrode portions electrically connectable the other one of the grounding and non-grounding side, the first electrode portions and the second electrode portions being arranged in a longitudinal direction of the substrate with spaces between adjacent electrode portions;

a plurality of heat generating portions, provided between adjacent electrode portions, respectively, for generating heat by electric power supply between adjacent electrode portions;

a first electroconductive line portion electrically connected with the plurality of first electrode portions, the first electroconductive line portion extending in the longitudinal direction with a gap between itself and the plurality of heat generating portions, in one end portion side with respect to a widthwise direction of the substrate beyond the plurality of heat generating portions;

a second electroconductive line portion electrically connected with the second electrode portion electrically connected with the heat generating portions in a first heat generating region arranged in the longitudinal direction, the second electroconductive line portion extending in the longitudinal direction in the other end portion side with respect to the widthwise direction beyond the plurality of heat generating portions; and a third electroconductive line portion electrically connected with the second electrode portion electrically connected with the heat generating portions in a second heat generating region arranged in the longitudinal direction, the second electroconductive line portion extending adjacent to the second electroconductive line portion in the longitudinal direction in the other end portion side with respect to the widthwise direction beyond the plurality of heat generating portions, wherein a gap between the second electroconductive line portion and the third electroconductive line portion in the widthwise direction is smaller than the gap between the first electroconductive line portion and the second electrode portion in the widthwise direction.

Other Embodiment

The present invention is not restricted to the specific dimensions in the foregoing embodiments. The dimensions may be changed properly by one skilled in the art depending on the situations. The embodiments may be modified in the concept of the present invention.

The heat generating region of the heater 600 is not limited to the above-described examples which are based on the sheets are supplied with the center thereof aligned with the center of the fixing device. Alternatively, the heat generating regions of the heater 600 may be modified so as to meet the case in which the sheets are supplied with one end thereof aligned with an end of the fixing device. More particularly, the heat generating elements corresponding to the heat generating region A are not heat generating elements 620*c*-620*j* but are heat generating elements 620*a*-620*e*. With such an arrangement, when the heat generating region is switched from that for a small size sheet to that for a large size sheet, the heat generating region does not expand at both of the opposite end portions, but rather expands at one of the opposite end portions.

The forming method of the heat generating element 620 is not limited to those disclosed in Embodiments 1, and 2. In Embodiment 1, the common electrode 642 and the opposite electrodes 652, 662 are laminated on the heat generating element 620 extending in the longitudinal direction of the substrate 610. However, the electrodes are formed in the form of an array extending in the longitudinal direction of the substrate 610, and the heat generating elements 620*a*-620*l* may be formed between the adjacent electrodes.

The belt 603 is not limited to that supported by the heater 600 at the inner surface thereof and driven by the roller 70. For example, so-called belt unit type in which the belt is extended around a plurality of rollers and is driven by one of the rollers. However, the structures of Embodiments 1-4 are preferable from the standpoint of low thermal capacity.

The member cooperative with the belt 603 to form of the nip N is not limited to the roller member such as a roller 70. For example, it may be a so-called pressing belt unit including a belt extended around a plurality of rollers.

The image forming apparatus which has been a printer 1 is not limited to that capable of forming a full-color, but it may be a monochromatic image forming apparatus. The image forming apparatus may be a copying machine, a facsimile machine, a multifunction machine having the function of them, or the like, for example.

The image heating apparatus is not limited to the apparatus for fixing a toner image on a sheet P. It may be a device for fixing a semi-fixed toner image into a completely fixed image, or a device for heating an already fixed image. Therefore, the fixing device 40 as the image heating apparatus may be a surface heating apparatus for adjusting a glossiness and/or surface property of the image, for example.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-108591 filed on May 26, 2014, which is hereby incorporated by reference herein in its entirety.

What is claimed is:

1. A heater usable with an image heating apparatus including an electric energy supplying portion provided with a first terminal and a second terminal, and an endless belt for heating an image on a sheet, wherein said heater is contactable to the belt to heat the belt, said heater comprising:

a substrate;

a plurality of electrode portions including a plurality of first electrode portions electrically connectable with the first terminal and a plurality of second electrode portions electrically connectable with the second terminal, said first electrode portions and said second electrode portions are arranged in a longitudinal direction of said substrate with spaces between adjacent electrode portions;

a plurality of heat generating portions, provided between adjacent electrode portions, respectively, for generating heat by electric power supply between adjacent electrode portions;

a first electroconductive line portion electrically connected with said plurality of first electrode portions, said first electroconductive line portion extending in the longitudinal direction with a gap between itself and said plurality of heat generating portions, in one end portion side with respect to a widthwise direction of said substrate beyond said plurality of heat generating portions;

a second electroconductive line portion electrically connected with said second electrode portions electrically connected with said heat generating portions in a first heat generating region arranged in the longitudinal direction, said second electroconductive line portion extending in the longitudinal direction in the other end portion side with respect to the widthwise direction beyond said plurality of heat generating portions; and a third electroconductive line portion electrically connected with one of said second electrode portions electrically connected with said heat generating portions in a second heat generating region arranged in the longitudinal direction, said third electroconductive line portion extending adjacent to said second electroconductive line portion in the longitudinal direction in the other end portion side with respect to the widthwise direction beyond said plurality of heat generating portions, wherein a gap between said second electroconductive line portion and said third electroconductive line portion in the widthwise direction is smaller than the gap between said first electroconductive line portion and said second electrode portions in the widthwise direction.

2. A heater according to claim 1, wherein said second electroconductive line portion is outside said third electroconductive line portion with respect to the widthwise direction, and a gap between said second electroconductive line portion and said third electroconductive line portion in the widthwise direction is smaller than a gap between said first electroconductive line portion and said second electroconductive line portion outside of said plurality of heat generating portions with respect to the longitudinal direction.

3. A heater according to claim 2, wherein a contact portion is electrically connected with said third electroconductive line portion and electrically connectable with the second terminal through a connector portion of the electric energy supplying portion in one end portion side of the substrate with respect to the longitudinal direction beyond the plurality of heat generating portions.

4. A heater according to claim 1, further comprising, a first electrical contact provided in one end portion side of said substrate beyond said plurality of heat generating portions with respect to the longitudinal direction, electrically connected with said first electroconductive line portion and electrically connectable with the first terminal through a connector portion of an electric energy supplying portion;

a second electrical contact provided in the one end portion side of said substrate beyond said plurality of heat generating portions with respect to the longitudinal direction, electrically connected with said second electroconductive line portion and electrically connectable with the second terminal through the connector portion; and a third electrical contact provided in the one end portion side of said substrate beyond said plurality of heat generating portions with respect to the longitudinal direction, electrically connected with said third electroconductive line portion and electrically connectable with the second terminal through the connector portion, wherein said first electrical contact is adjacent to one end portion side of said third electrical contact with respect to the longitudinal direction, and said second electrical contact is adjacent to the other end portion side of said third electrical contact with respect to the longitudinal direction, wherein a gap between said second electroconductive line portion and said third electroconductive line portion in the widthwise direction is smaller than a gap between said second electrical contact and said third electrical contact in the longitudinal direction.

5. A heater according to claim 1, further comprising, a first electrical contact provided in one end portion side of said substrate beyond said plurality of heat generating portions with respect to the longitudinal direction, electrically connected with said first electroconductive line portion and electrically connectable with the first terminal through a connector portion of an electric energy supplying portion;

a second electrical contact provided in the one end portion side of said substrate beyond said plurality of heat generating portions with respect to the longitudinal direction, electrically connected with said second electroconductive line portion and electrically connectable with the second terminal through the connector portion; and a third electrical contact provided in the one end portion side of said substrate beyond said plurality of heat generating portions with respect to the longitudinal direction, electrically connected with said third electroconductive line portion and electrically connectable with the second terminal through the connector portion, wherein said first electrical contact is adjacent to one end portion side of said third electrical contact with respect to the longitudinal direction, and said second electrical contact is adjacent to the other end portion side of said third electrical contact with respect to the longitudinal direction, wherein a gap between said second electrode portions and said first electroconductive line portion in the widthwise direction is smaller than a gap between said first electrical contact and said second electrical contact in the longitudinal direction.

6. A heater according to claim 1, further comprising, a first electrical contact provided in one end portion side of said substrate beyond said plurality of heat generating portions with respect to the longitudinal direction, electrically connected with said first electroconductive line portion and electrically connectable with the first terminal through a connector portion of an electric energy supplying portion;

a second electrical contact provided in the one end portion side of said substrate beyond said plurality of heat generating portions with respect to the longitudinal direction, electrically connected with said second electroconductive line portion and electrically connectable with the second terminal through the connector portion; and a third electrical contact provided in the one end portion side of said substrate beyond said plurality of heat generating portions with respect to the longitudinal direction, electrically connected with said third electroconductive line portion and electrically connectable with the second terminal through the connector portion, wherein said first electrical contact is adjacent to one end portion side of said third electrical contact with respect to the longitudinal direction, and said second electrical contact is adjacent to the other end portion side of said third electrical contact with respect to the longitudinal direction, wherein a gap between said second electrical contact and said third electrical contact in the longitudinal direction is smaller than a gap between said first electrical contact and said second electrical contact in the longitudinal direction.

7. An image heating apparatus comprising:

an electric energy supplying portion provided with a first terminal and a second terminal;

a belt configured to heat an image on a sheet;

a substrate provided inside said belt and extending in a widthwise direction of said belt;

a plurality of electrode portions including a plurality of first electrode portions electrically connectable with the first terminal and a plurality of second electrode portions electrically connectable with the second terminal, said first electrode portions and said second electrode portions are arranged in a longitudinal direction of said substrate with spaces between adjacent electrode portions;

a plurality of heat generating portions, provided between adjacent electrode portions, respectively, for generating heat by electric power supply between adjacent electrode portions, a first electroconductive line portion electrically connected with said plurality of first electrode portions, said first electroconductive line portion being extending in the longitudinal direction with a gap between itself and said plurality of heat generating portions, in one end portion side with respect to a widthwise direction of said substrate beyond said plurality of heat generating portions;

a second electroconductive line portion electrically connected with said second electrode portions electrically connected with said heat generating portions in a first heat generating region arranged in the longitudinal direction, said second electroconductive line portion extending in the longitudinal direction in the other end portion side with respect to the widthwise direction beyond said plurality of heat generating portions; and a third electroconductive line portion electrically connected with one of said second electrode portions electrically connected with said heat generating portions in a second heat generating region arranged in the longitudinal direction, said second electroconductive line portion being extended adjacent to said second electroconductive line portion in the longitudinal direction in the other end portion side with respect to the widthwise direction beyond said plurality of heat generating portions, wherein when a sheet having a maximum width usable with said apparatus is heated, electric energy is supplied through said first electroconductive line and all of said electroconductive line portions including said second electroconductive line portion and said third electroconductive line portion so that all of said heat generating portions generate heat, and wherein when a sheet having a width smaller than the maximum width is heated, electric energy is supplied through said first electroconductive line portion and a part of said second electroconductive line portion so that a part of said heat generating portions generate heat, and wherein a gap between said second electroconductive line portion and said third electroconductive line portion in the widthwise direction is smaller than the gap between said first electroconductive line portion and said second electrode portions in the widthwise direction.

8. An apparatus according to claim 7, wherein said second electroconductive line portion is outside said third electroconductive line portion with respect to the widthwise direction, and a gap between said second electroconductive line portion and said third electroconductive line portion in the widthwise direction is smaller than a gap between said first electroconductive line portion and said second electroconductive line portion outside of said plurality of heat generating portions with respect to the longitudinal direction.

9. An apparatus according to claim 8, wherein a contact portion is electrically connected with said third electroconductive line portion and electrically connectable with the second terminal through a connector portion of the electric energy supplying portion in one end portion side of the substrate with respect to the longitudinal direction beyond the plurality of heat generating portions.

10. An apparatus according to claim 7, wherein said heater further includes, a first electrical contact provided in one end portion side of said substrate beyond said plurality of heat generating portions with respect to the longitudinal direction, electrically connected with said first electroconductive line portion and electrically connectable with the first terminal through a connector portion of an electric energy supplying portion;

a second electrical contact provided in the one end portion side of said substrate beyond said plurality of heat generating portions with respect to the longitudinal direction, electrically connected with said second electroconductive line portion and electrically connectable with the second terminal through the connector portion; and a third electrical contact provided in the one end portion side of said substrate beyond said plurality of heat generating portions with respect to the longitudinal direction, electrically connected with said third electroconductive line portion and electrically connectable with the second terminal through the connector portion, wherein said first electrical contact is adjacent to one end portion side of said third electrical contact with respect to the longitudinal direction, and said second electrical contact is adjacent to the other end portion side of said third electrical contact with respect to the longitudinal direction, wherein a gap between said second electroconductive line portion and said third electroconductive line portion in the widthwise direction is smaller than a gap between said second electrical contact and said third electrical contact in the longitudinal direction.

11. An apparatus according to claim 7, wherein said heater further includes, a first electrical contact provided in one end portion side of said substrate beyond said plurality of heat generating portions with respect to the longitudinal direction, electrically connected with said first electroconductive line portion and electrically connectable with the first terminal through a connector portion of an electric energy supplying portion;

a second electrical contact provided in the one end portion side of said substrate beyond said plurality of heat generating portions with respect to the longitudinal direction, electrically connected with said second electroconductive line portion and electrically connectable with the second terminal through the connector portion; and a third electrical contact provided in the one end portion side of said substrate beyond said plurality of heat generating portions with respect to the longitudinal direction, electrically connected with said third electroconductive line portion and electrically connectable with the second terminal through the connector portion, wherein said first electrical contact is adjacent to one end portion side of said third electrical contact with respect to the longitudinal direction, and said second electrical contact is adjacent to the other end portion side of said third electrical contact with respect to the longitudinal direction, wherein a gap between said second electrode portions and said first electroconductive line portion in the widthwise direction is smaller than a gap between said first electrical contact and said second electrical contact in the longitudinal direction.

12. An apparatus according to claim 7, wherein said heater further includes a first electrical contact provided in one end portion side of said substrate beyond said plurality of heat generating portions with respect to the longitudinal direction, electrically connected with said first electroconductive line portion and electrically connectable with the first terminal through a connector portion of an electric energy supplying portion;

a second electrical contact provided in the one end portion side of said substrate beyond said plurality of heat generating portions with respect to the longitudinal direction, electrically connected with said second electroconductive line portion and electrically connectable with the second terminal through the connector portion; and a third electrical contact provided in the one end portion side of said substrate beyond said plurality of heat generating portions with respect to the longitudinal direction, electrically connected with said third electroconductive line portion and electrically connectable with the second terminal through the connector portion, wherein said first electrical contact is adjacent to one end portion side of said third electrical contact with respect to the longitudinal direction, and said second electrical contact is adjacent to the other end portion side of said third electrical contact with respect to the longitudinal direction, wherein a gap between said second electrical contact and said third electrical contact in the longitudinal direction is smaller than a gap between said first electrical contact and said second electrical contact in the longitudinal direction.

13. An apparatus according to claim 7, wherein when the heat generating portions are supplied with electric energy through all of said first and second electrical contacts, the directions of electric currents through adjacent ones of heat generating portions are opposite to each other.

14. An apparatus according to claim 7, wherein said electric energy supplying portion includes an AC circuit.

15. A heater comprising:

a substrate;

a plurality of electrode portions including a plurality of first electrode portions electrically connectable with one of a grounding and non-grounding side of an electric power source and a plurality of second electrode portions electrically connectable with the other one of the grounding and non-grounding side, the first electrode portions and the second electrode portions are arranged in a longitudinal direction of the substrate with spaces between adjacent electrode portions;

a plurality of heat generating portions, provided between adjacent electrode portions, respectively, for generating heat by electric power supply between adjacent electrode portions;

a first electroconductive line portion electrically connected with the plurality of first electrode portions, the first electroconductive line portion extending in the longitudinal direction with a gap between itself and the plurality of heat generating portions, in one end portion side with respect to a widthwise direction of the substrate beyond the plurality of heat generating portions;

a second electroconductive line portion electrically connected with the second electrode portions electrically connected with the heat generating portions in a first heat generating region arranged in the longitudinal direction, the second electroconductive line portion extending in the longitudinal direction in the other end portion side with respect to the widthwise direction beyond the plurality of heat generating portions; and a third electroconductive line portion electrically connected with one of the second electrode portions electrically connected with the heat generating portions in a second heat generating region arranged in the longitudinal direction, the second electroconductive line portion extending adjacent to the second electroconductive line portion in the longitudinal direction in the other end portion side with respect to the widthwise direction beyond the plurality of heat generating portions, wherein a gap between the second electroconductive line portion and the third electroconductive line portion in the widthwise direction is smaller than the gap between the first electroconductive line portion and the second electrode portions in the widthwise direction.

* * * * *